US007325567B2

(12) United States Patent
Heyden et al.

(10) Patent No.: US 7,325,567 B2
(45) Date of Patent: Feb. 5, 2008

(54) PNEUMATIC RETARDER ACUTATOR VALVE

(75) Inventors: Thomas J. Heyden, Arlington Heights, IL (US); Lowell B. Ziese, Pewaukee, WI (US); James D. Braatz, Greenfield, WI (US)

(73) Assignee: AAA Sales & Engineering, Inc., Oak Creek, WI (US)

( * ) Notice: Subject to any disclaimer, the term of this patent is extended or adjusted under 35 U.S.C. 154(b) by 306 days.

(21) Appl. No.: 10/887,951

(22) Filed: Jul. 8, 2004

(65) Prior Publication Data

US 2005/0005811 A1 Jan. 13, 2005

Related U.S. Application Data

(60) Provisional application No. 60/485,541, filed on Jul. 8, 2003.

(51) Int. Cl.
*F16K 31/02* (2006.01)

(52) U.S. Cl. ..... 137/596.17; 137/601.14; 137/271; 303/118.1

(58) Field of Classification Search ..... 137/596, 137/596.17, 270–271, 601.14, 599.01; 303/128, 303/118.1
See application file for complete search history.

(56) References Cited

U.S. PATENT DOCUMENTS

| | | | | | |
|---|---|---|---|---|---|
| 1,931,142 | A * | 10/1933 | Clausen | 303/20 |
| 3,332,524 | A * | 7/1967 | Tilden et al. | 188/180 |
| RE31,204 | E * | 4/1983 | Sanner | 137/78.3 |
| 4,709,124 | A * | 11/1987 | Wheeler et al. | 174/668 |
| 5,092,248 | A | 3/1992 | Parry | 104/26.2 |
| 5,388,525 | A * | 2/1995 | Bodkin | 104/26.2 |
| 5,654,885 | A * | 8/1997 | Mayhew et al. | 700/282 |
| 5,676,337 | A | 10/1997 | Giras | 246/182 A |
| 5,720,534 | A | 2/1998 | Stumpe | 303/166 |
| 6,152,042 | A | 11/2000 | Barry | 104/26.2 |
| 6,220,400 | B1 | 4/2001 | Kickbush | 188/62 |
| 6,829,796 | B2 * | 12/2004 | Salvatini et al. | 5/713 |
| 6,953,047 | B2 * | 10/2005 | Birtcher et al. | 137/240 |
| 2002/0029812 | A1 * | 3/2002 | Hotta et al. | 137/613 |
| 2006/0202052 | A1 * | 9/2006 | Boecking | 239/88 |

OTHER PUBLICATIONS

L & W Industries, Inc. RCV-1 Retarder Control Valve literature dated Oct. 1987.

(Continued)

*Primary Examiner*—Eric Keasel
*Assistant Examiner*—Craig Schneider
(74) *Attorney, Agent, or Firm*—Andrus, Sceales, Starke & Sawall, LLP

(57) ABSTRACT

The present invention pertains to an electro-pneumatic retarder control (EPRC) valve for a pneumatic retarder that controls the speed of railroad cars in a marshaling yard. The EPRC valve has a housing that generally encloses and protects its various components. The housing has a lid that can be opened to gain access to a control panel mounted on an interior door. The control panel includes a display, keyboard and programmable logic controller or PLC module that can be adjusted to set the desired pressure levels of the retarder. The EPRC valve has a modular pressure control assembly that includes an intake and exhaust manifold, a retarder supply and return manifold and several interchangeable control lines formed by like-shaped control valves and components. A pilot air control assembly enables the PLC module to selectively open and close the control valves and lines to deliver or release pressurized air to the retarder.

17 Claims, 26 Drawing Sheets

OTHER PUBLICATIONS

Wabco Services Manual 5311 for Type HS-2, HS-2A and HS-2B Retarder Control Valve dated Sep. 1979.

AAA Sales & Engineering GFV-01 brochure published prior to 2000 (1 page publication).

* cited by examiner

H

1/X
1/X
400
TBIT2=0 (UNDER A LIGHT PRESSURE CALL, THE LIGHT PRESSURE HAS NOT BEEN EXCEEDED.)
TBIT4=0 (SAME FUNCTION AS TBIT2 FOR MEDIUM)
TBIT6=0 (SAME FUNCTION AS TBIT2 FOR HEAVY)
TBIT8=0 (SAME FUNCTION AS TBIT2 FOR EX-HEAVY)
?
405
IBIT5=0 (TOWER HAS NOT ISSUED OPEN COMMAND)
?
410
TBIT30=0 (AUTO VS. MANUAL SWITCH IS SET TO MANUAL)
?
415
TBIT138=0 (MANUAL OPEN COMMAND HAS NOT BEEN GIVEN)
?
420
SET TBIT17=1 (OPEN EXHAUST VALVES)
I

T REGISTER= A NON-RETENTIVE 1-BIT MEMORY LOCATION, USED TO STORE APPLICATION SPECIFIC STATE INFORMATION.

TBIT1 INDICATES IF RETARDER PRESSURE IS LOW ENOUGH TO TRIGGER AN OPENING OF THE INLET VALVE FOR LIGHT AND THAT A VALID LIGHT COMMAND IS PRESENT.
TBIT2 INDICATES IF RETARDER PRESSURE HAS BEEN EXCEEDED LIGHT.
TBIT3 INDICATES IF RETARDER PRESSURE IS LOW ENOUGH TO TRIGGER AN OPENING OF THE INLET VALVE FOR MEDIUM AND THAT A VALID MEDIUM COMMAND IS PRESENT.
TBIT4 INDICATES IF RETARDER PRESSURE HAS BEEN EXCEEDED MEDIUM.
TBIT5 INDICATES IF RETARDER PRESSURE IS LOW ENOUGH TO TRIGGER AN OPENING OF THE INLET VALVE FOR HEAVY AND THAT A VALID HEAVY COMMAND IS PRESENT.
TBIT6 INDICATES IF RETARDER PRESSURE HAS BEEN EXCEEDED HEAVY.
TBIT7 INDICATES IF RETARDER PRESSURE IS LOW ENOUGH TO TRIGGER AN OPENING OF THE INLET VALVE FOR EXTRA-HEAVY AND THAT A VALID EXTRA-HEAVY COMMAND IS PRESENT.
TBIT8 INDICATES IF RETARDER PRESSURE HAS BEEN EXCEEDED EXTRA-HEAVY.
TBIT9 INDICATES VALID TOWER COMMAND FOR LIGHT.
TBIT10 INDICATES VALID MANUAL COMMAND FOR LIGHT.
TBIT11 INDICATES VALID TOWER COMMAND FOR MEDIUM.
TBIT12 INDICATES VALID MANUAL COMMAND FOR MEDIUM.
TBIT13 INDICATES VALID TOWER COMMAND FOR HEAVY.
TBIT14 INDICATES VALID MANUAL COMMAND FOR HEAVY.
TBIT15 INDICATES VALID TOWER COMMAND FOR EXTRA HEAVY.
TBIT16 INDICATES VALID MANUAL COMMAND FOR EXTRA HEAVY.
TBIT17 INDICATES IF THE EXHAUST VALVES SHOULD BE OPEN OR CLOSED.
TBIT30 INDICATES IF THE UNIT IS IN TOWER OR MANUAL CONTROL.
TBIT35 INDICATES IF 2 EXHAUST VALVES ARE PRESENT.
TBIT36 INDICATES IF 3 EXHAUST VALVES ARE PRESENT.
TBIT37 INDICATES IF RETARDER PRESSURE IS BELOW USER SPECIFIED BOTTOM OF PRESSURE CLASS.
TBIT38 INDICATES IF RETARDER PRESSURE IS BELOW ARTIFICIALLY LOW BOTTOM OF PRESSURE CLASS.
TBIT39 INDICATES IF RETARDER PRESSURE IS BELOW ARTIFICIALLY LOW BOTTOM OF THE PRESSURE WEIGHT CLASS AND THE USER SPECIFIED BOTTOM OF THE PRESSURE WEIGHT CLASS.
TBIT138 INDICATES EITHER A MOMENTARY OR CONTINUOUS VALID MANUAL OPEN COMMAND.
TBIT143 INDICATES IF THE USER HAS INPUT VALID PRESSURE SETTINGS, E.G. THE UPPER END OF THE PRESSURE CLASSES EXCEEDS THE LOWER END OF THE PRESSURE CLASSES.

M REGISTER= A RETENTIVE 1-BIT MEMORY LOCATION, USED TO STORE APPLICATION SPECIFIC STATE INFORMATION.

MBIT1 STORES STATUS OF MANUAL MODE.
MBIT2 STORES STATUS OF TOWER MODE.

R REGISTER= A RETENTIVE 16-BIT MEMORY LOCATION, USED TO STORE APPLICATION SPECIFIC VALUES.

R2 USER SPECIFIED LOWEST PRESSURE FOR LIGHT.
R3 USER SPECIFIED HIGHEST PRESSURE OF LIGHT.
R53 USER SPECIFIED VALUE FOR THE NUMBER OF EXHAUST VALVES.
R54 ADDITIONAL PRESURE DEAD BAND TO ELIMINATE VALVE HUNTING AT EDGE OF PRESSURE RANGE.
R55 ARTIFICIALLY LOW BOTTOM OF LIGHT PRESSURE RANGE.
R62 ARTIFICIALLY HIGH TOP FOR LIGHT PRESSURE RANGE.

K REGISTER= A NON-RETENTIVE 1-BIT MEMORY LOCATION, USED TO STORE THE STATE OF A FUNCTION KEY ON THE CONTROL STATION'S KEYPAD.

KBIT1 STATE OF MANUAL BUTTON FOR LIGHT.
KBIT2 STATE OF MANUAL BUTTON FOR MEDIUM.
KBIT3 STATE OF MANUAL BUTTON FOR HEAVY.
KBIT4 STATE OF MANUAL BUTTON FOR EXTRA HEAVY.
KBIT5 STATE OF MANUAL BUTTON FOR OPEN.

I REGISTER= A NON-RETENTIVE MEMORY LOCATION, WHICH IS NORMALLY USED TO STORE THE STATE OF ONE OF THE DIGITAL INPUTS ASSOCIATED WITH A PHYSICAL I/O MODULE.

IBIT1 TOWER LIGHT COMMAND.
IBIT2 TOWER MEDIUM COMMAND.
IBIT3 TOWER HEAVY COMMAND.
IBIT4 TOWER EXTRA HEAVY COMMAND.
IBIT5 TOWER OPEN COMMAND.

Q-REGISTER= A NON-RETENTIVE MEMORY LOCATION, WHICH IS NORMALLY USED TO STORE THE STATE OF ONE OF THE DIGITAL OUTPUTS ASSOCIATED WITH A PHYSICAL I/O MODULE.

QBIT1 OUTPUT TO ACTIVATE 3/4" INLET VALVE.
QBIT2 OUTPUT TO ACTIVATE 1 1/2" INLET VALVE.
QBIT3 OUTPUT TO ACTIVATE EXHAUST VALVE 1.
QBIT4 OUTPUT TO ACTIVATE EXHAUST VALVE 2.
QBIT5 OUTPUT TO ACTIVATE EXHAUST VALVE 3.

FIG. 17k

PNEUMATIC RETARDER ACUTATOR VALVE

This application asserts priority on U.S. Provisional Application Ser. No. 60/485,541 filed Jul. 8, 2003.

TECHNICAL FIELD OF THE INVENTION

The present invention relates to an electro-pneumatic retarder control (EPRC) with a programmable logic controller (PLC) module for controlling the flow of pressurized air supplied to and discharged from a pneumatic retarder in a railroad marshaling yard.

BACKGROUND OF THE INVENTION

Railroad retarders control the speed of railroad cars in a marshalling yard. Cars sent over the hump of the yard gain speed as they roll down the hump and are routed via a number of switches to an appropriate track for coupling to other cars on that track. The speed of the cars vary depending on the weight of the car, the speed it is sent over the hump, the number of switches and length of track it needs to traverse, the friction in the wheel bearings of the car, and various other factors. Controlling the speed of the cars is important to ensure the cars arrive at the desired track with an appropriate amount of speed to couple with the other cars. Too little speed, and the car will not make it where they need to go with enough speed to couple with the other cars on the track. Too much speed, and the car will jump the track or damage the coupling mechanisms.

A problem with conventional pneumatic retarder valves is that they are difficult to maintain. Diagnosing the source of a problem such as the malfunctioning component is difficult. The wrong components are frequently replaced in a trial and error effort to fix the valve. This results in great expense and frustration, and dramatically increases down time.

Another problem with conventional pneumatic retarder valves is the difficulty adjusting the upper and lower limits of the various pressure settings for the valve (LIGHT, MEDIUM, HEAVY and EXTRA-HEAVY). Some valves require the use of a very small screw driver to adjust variable resisters that form the source of the reference voltages that dictate the desired pressure limits for activating the opening and closing of the valve.

A further problem with conventional pneumatic retarder valves is that it is difficult to verify whether or not the pressure transducer is providing accurate actual retarder pressure information to the valve. The electric signal or pressure data sent by the transducer to the circuit board is difficult to measure. Although an alternate gage can be used to determine the actual pressure from the retarder cylinders that is being received at the retarder valve, there is no easy way to verify that the transducer signal is sending a signal to the circuit board that accurately corresponds to the actual retarder pressure. Instead of simply replacing a failing or faulty pressure transducer, field personnel attempt to correct the pressure anomalies by adjusting other components such as the variable resisters that set the pressure limits, which fails to correct the underlying problem, can lead to other operational problems in the retarder valve and can lead to accident and injury.

A still further problem with conventional pneumatic retarder valves is their electrical systems. The systems are polarity sensitive and can be damaged by inadvertently switching the positive and negative leads. Separate 12 and 24 VDC assemblies are also needed depending on the input voltage. Power surges such as by lighting strikes can also easily damage the electrical system.

A still further problem with conventional pneumatic retarder valves is that the electronics are difficult to replace. A lightning strike can shut down the control valve for a long time.

A still further problem with conventional pneumatic retarder valves is that they include valves and other components that require frequent lubrication and other maintenance due to the harsh chemicals found in marshalling yards.

A still further problem with conventional pneumatic retarder valves is that they include a large amount of piping and fittings. These components frequently leak the pressurized air they are meant to contain. This leaking wastes air, causes the yard compressors to run more frequently, and reduces the capacity of the pressurized air system for the yard.

A still further problem with conventional pneumatic retarder valves is that many components are exposed to possible damage by parts being dragged by the railroad cars, the environment and rodents.

The present invention is intended to solve these and other problems.

BRIEF DESCRIPTION OF THE INVENTION

The present invention pertains to an electro-pneumatic retarder control (EPRC) valve for a pneumatic retarder that controls the speed of railroad cars in a marshaling yard. The EPRC valve has a housing that generally encloses and protects its various components. The housing has a lid that can be opened to gain access to a control panel mounted on an interior door. The control panel includes a display, keyboard and programmable logic controller or PLC module that can be adjusted to set the desired pressure levels of the retarder. The EPRC valve has a modular pressure control assembly that includes an intake and exhaust manifold, a retarder supply and return manifold and several interchangeable control lines formed by like-shaped control valves and components. A pilot air control assembly enables the PLC module to selectively open and close the control valves and lines to deliver or release pressurized air to the retarder.

One advantage of the present electro-pneumatic retarder control valve is its modular design, which makes it easy to maintain and repair. The valve has easier service pneumatics. Several "at risk" components including the control valves and their actuating pilot valves are located between two manifolds. These components can be removed as a subassembly, and shipped back to the OEM for trouble shoot. This eliminates the need for trouble shooting at the yard and reduces equipment down time. The modular nature of the control assembly allows a new subassembly to be quickly installed so that the valve is up and running while the faulty subassembly is sent to the OEM for repair. The manifolds also greatly reduce the number of connections and make the assembly of components much faster. The electronics are also easy to replace. Quick disconnects between all input wires and the electronics subassembly facilitate replacement of all electronics in the event of a lightning strike.

Another advantage of the present electro-pneumatic retarder control valve is the ease with which the upper and lower pressure limits can be entered or modified. The control panel allows the user to both view any existing pressure limits on the display, and then simply use the keypad to enter or modify the desired pressure limits for the various weight classes (LIGHT, MEDIUM, HEAVY and EXTRA- HEAVY). Field personnel simply type in the desired upper and lower pressure limits for each weight class. No tools are needed.

A further advantage of the present electro-pneumatic retarder control valve is its simple verification of the pressure transducer. The actual retarder pressure sensed by the transducer is converted into a pressure data signal that is converted into a readable numeric value and displayed by the control panel. This occurs each time a weight class is requested. The EPRC valve includes a port for attaching an alternate pneumatic or analog pressure gage that is know to be accurate. This alternate pressure gage measures the actual pressure being received by the EPRC valve from the expandable cylinders or chamber of the retarder. Field personnel can easily verify that the pressure transducer is functioning properly by comparing the pressure shown in the control panel display to the pressure reading of the alternate gage. This allows for in service testing of the pressure transducer and helps avoid guess work.

A still further advantage of the present electro-pneumatic retarder control valve is that personnel in the control tower for the yard can remotely determine the presently selected weight class, and remotely set or otherwise modify the weight class setting to a desired weight class setting.

A still further advantage of the present electro-pneumatic retarder control value is its simple vercation that the yard tower command has reach the value. Whenever a brake appalication is requested, the tower command is displayed on the control panel screen.

A still further advantage of the present electro-pneumatic retarder control valve is its adaptable and easy maintenance electrical system. The electrical system is polarity protected. Inadvertent switching of the positive or hot lead and the negative or common leads or terminals will not damage the system or cause it to malfunction. The electrical system can also automatically adapt to run on a 12 VDC or a 24 VDC power supply. This eliminates the need for separate 12 and 24 VDC assemblies. The valve operates satisfactorily over a range of 9-35 VDC. In addition, the electrical system has surge protection. All wires entering the unit, including the 9-35 VDC power, are optically isolated from the electronics subassembly.

A still further advantage of the present EPRC valve is its lubricant-free design. The assembly has internally protected valves that are more reliable and do not require lubrication. The valves have excellent endurance test results under exposure to harsh chemicals.

A still further advantage of the present electro-pneumatic retarder control valve is the simplicity of its pneumatic pressure control system. The manifolds and compact control lines reduce the amount of piping and number of fittings so that the opportunities for leaks are greatly reduced.

A still further advantage of the present EPRC valve is that it provides a protective environment surrounding its working components. The robustly designed NEMA rated housing protects and seals all the active working components from the environment, pieces of railcars that may be dragging, and rodents and insects.

A still further advantage of the present EPRC valve is that it obtains a higher valve shifting force by using double acting pilot valves. The force opening the control valve is not reduced by the force of a return spring in the pilot valve. In addition, the force produced by the pilot valve for closing the control valve far exceeds the force supplied by a return spring.

A still further advantage of the present EPRC valve is that it reduces user cost by reducing the need for auxiliary exhaust valves. The use of higher flow control valves and the capacity of the manifold to accept up to three exhaust valves eliminates the need for auxiliary exhaust valves for many retarder applications.

A still further advantage of the present electro-pneumatic retarder control valve is its economic design and reduced noise. The air exhaust mufflers are vertically mounted. Air and sound waves are emitted radially or horizontally. The air waves are directed horizontally within a three sided enclosure. The exhaust air does not impact the ground and propel dust and debris into the air. A three-sided shield also protects maintenance personnel from the exhaust air.

A still further advantage of the present EPRC valve is its simple and aesthetically pleasing design. Virtually all the components are enclosed within a simple NEMA 4 box or housing with a maintenance access door. Components are not hanging on pipes or under a heavy cover as was done on previous designs.

A still further advantage of the present EPRC valve is that it is a direct replacement for HS-2, HS-2A, HS-2B, GFV-96, GFV-01 and L&W retarder valve control assemblies.

Other aspects and advantages of the invention will become apparent upon making reference to the specification, claims and drawings.

BRIEF DESCRIPTION OF THE DRAWINGS

FIGS. 17*a-k* show a schematic diagram and legend of the operating program for the EPRC valve.

DESCRIPTION OF THE PREFERRED EMBODIMENTS

While this invention is susceptible of embodiment in many different forms, the drawings show and the specification describes in detail a preferred embodiment of the invention. It should be understood that the drawings and specification are to be considered an exemplification of the principles of the invention. They are not intended to limit the broad aspects of the invention to the embodiment illustrated.

Figure 1:
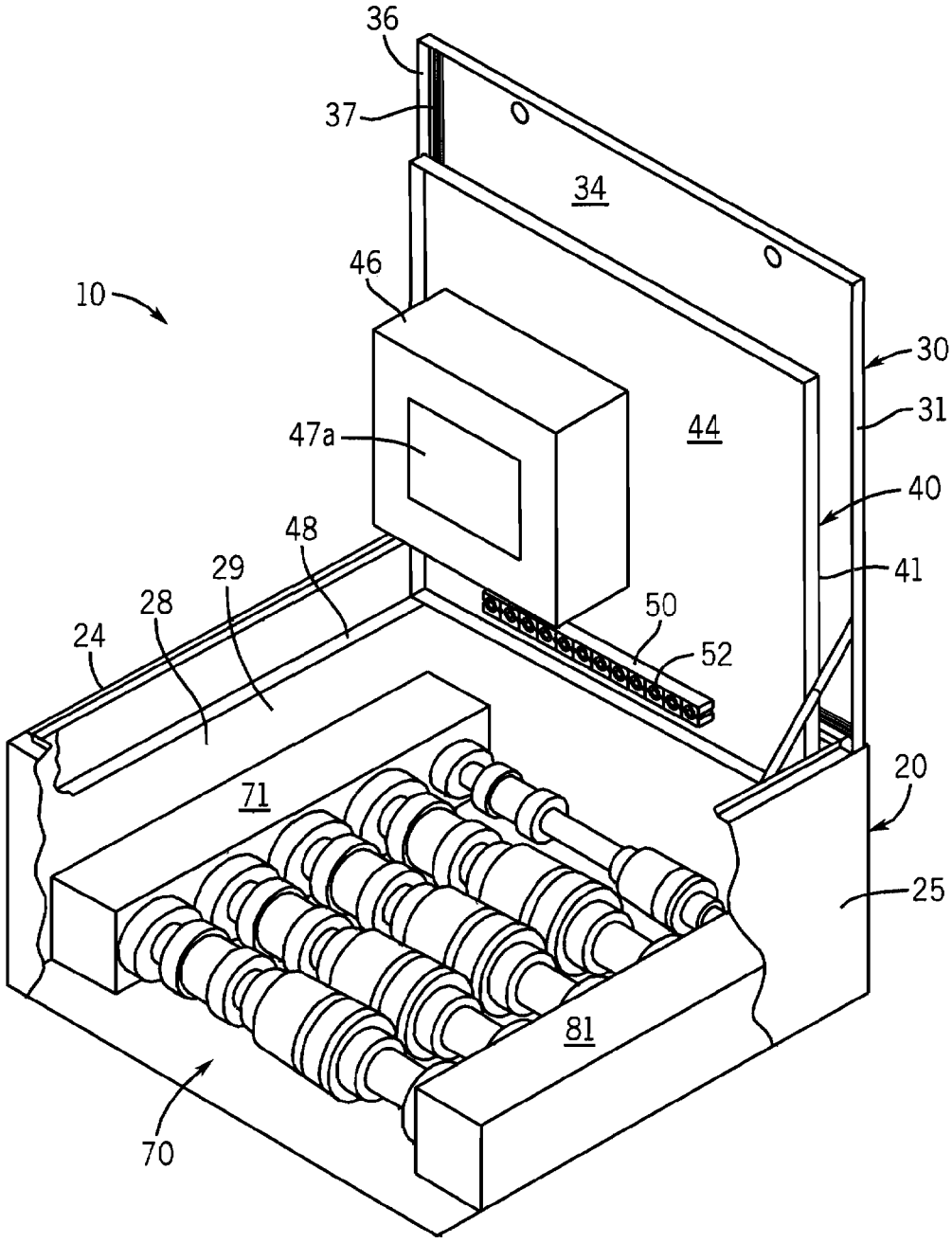
FIG. 1 is a perspective, cut away view of the present electro pneumatic retarder control (EPRC) valve with its lid and access door open to show its modular control valve assembly.
Figure 2:
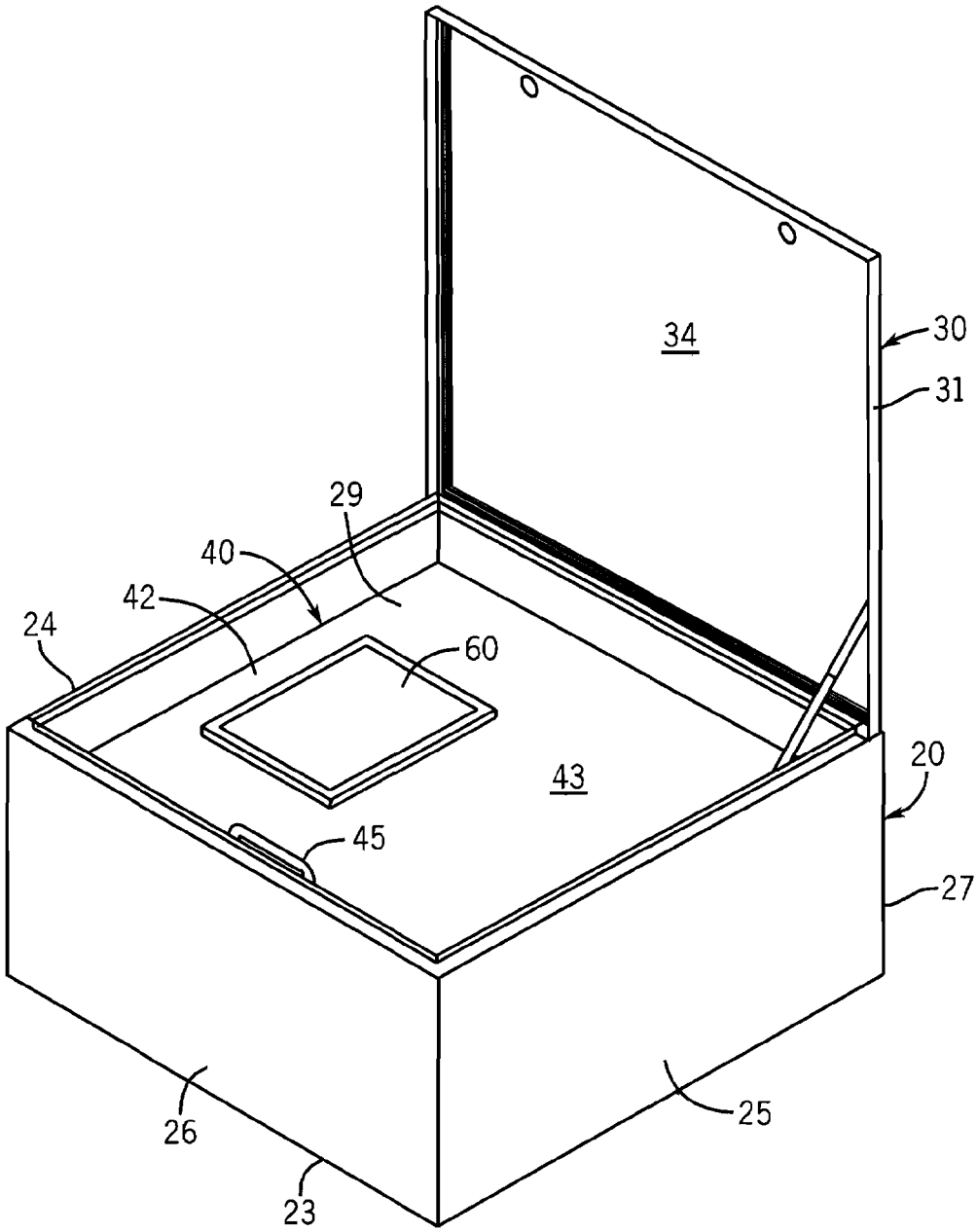
FIG. 2 is a perspective view of the EPRC valve with the lid open and access door closed to show its display and control panel.

The present invention relates to an electro-pneumatic retarder control (EPRC) or control valve assembly generally indicated by reference number 10 and shown in FIGS. 1 and 2. The control valve assembly 10 is typically installed within a few feet of a marshalling yard retarder (not shown), which moves its brakes into braking engagement against the wheels of the cars. The valve assembly 10 is divided into four areas or quadrants 11-14. Pressurized air is received by the valve assembly 10 via its intake quadrant 11, and controllably delivers the pressurized air to its supply quadrant 12, which is in pneumatic communication with the retarder. The pressurized air delivered to the retarder is in pneumatic communication with the return quadrant 13, and controllably exhausted by the valve 10 to the surrounding atmosphere via the exhaust quadrant 14.

The EPRC or control valve assembly 10 has a housing 20 that generally encloses the other various components of the assembly. The housing 20 is preferably elevated from the ground by a support stand (not shown) having a height of about 36 inches. This stand is made of welded heavy-duty steel to form a weather resistant platform for the housing 20. The housing 20 has a top 22 and a bottom 23, and front, rear and sidewalls 24-27 with inside surfaces 28 that form a main compartment 29 that preferably has first and fourth areas or quadrants 11 and 14 located along the front wall 24, and second and third areas or quadrants 12 and 13 located along the rear wall 25. The housing 20 is relatively compact, and has a length of about 24 inches, a width of about 24 inches and a height of about 12 inches. The housing 20 and its stand are robustly designed to retain their shape and integrity during the typically rugged conditions of a railroad marshalling yard. The housing 20 is relatively light with a weight of about 194 pounds without the stand and about 294 pounds with the stand. The housing 20 and stand are preferably made of thick sheet metal with painted exterior surfaces to inhibit rust and deterioration. The original housing 20 forms a NEMA 4× rated steel enclosure and it is anticipated that the housing will maintain its ability to protect internal components from environmental conditions present in a rail yard.

The housing 20 has an outer door or lid 30 that is movable between open 31 and closed 32 positions to gain access to or close and seal the inside compartment 29. The outer access door or lid 30 has upper and lower surfaces 33 and 34. One end of the lid 30 is hinged or otherwise rigidly connected to the top end of one sidewall 27. When the lid 30 is in its open position 31 as in FIGS. 1 and 2, the top 22 of the housing is open. When the lid 30 is in its closed position 32 as in FIGS. 6-8, the top 22 is closed. The outer perimeter of the lid 30 has a downwardly projecting rim 36 and an adjacent gasket 37 secured to its lower surface 34. The rim 36 flushly engages the outside surface of the top ends of the housing walls 24-27 when the lid is in its closed position 32. The gasket 37 is aligned to mate with and seal against the top ends of the walls 24-27. The weight of the lid 30 and a latch (not shown) maintain the lid in its sealed position 32 during use. The seal is sufficiently tight to prevent the entry of dust, humidity and insect infestation into the compartment 29 of the housing 20 when the lid is in its closed position 32.

An interior access door 40 is accessible when the outer door or lid 30 is in its open position 31. The interior door 40 is also selectively movable between open 41 and closed 42 positions to gain access to or close the inner most portion of the chamber 29. The interior door 40 has upper or outer surface 43 and lower or inner surface 44. One end of the access door 40 is hinged or otherwise rigidly connected to sidewalls 24 and 25, in close proximity to sidewall 27. The other end of the door 40 has a handle 45. The access door 40 includes an enclosure or recess 46 in the surface. The enclosure 46 has a length of about 10 inches, a width of about 10 inch, and a height of about 4 inches. A flat electric heater **47*a* is adhered or otherwise secured to the lower surface 44 for heating the control panel discussed below. A second more powerful or main heater 47*b* provides sufficient heat to maintain the interior compartment 29 and various interior components of the assembly 10 at or above a necessary or desired working temperature during operation in a cold outside environment. The main heater 47*b* has its own internal thermostat for activating and deactivating the heater. When the interior door 40 is in its open position 41 as in FIG. 1, the major portion of the housing 20 can be accessed through the top 22 of the housing. When the door 40 is in its closed position 42 as in FIG. 2, the major portion of the housing 20 is closed. The sidewalls 24-27 of the housing 20 form a ledge 48 that supports the door 40 when it is in its closed position 42**.

Electric power is delivered to the control valve 10 through a conventional terminal block 50 having a number of individual electrical terminals 52. The terminal block meets AAR standards, and is located on the lower side 44 of the inner access door 40 toward its hinged end. Electric cables enter the interior compartment 29 of the housing 20 through an electric access 55 shown in FIG. 7. This access 55 includes a seal tight connector 56 that inhibits the entry of moisture, dust and insect infestation into the housing 20. The internal wiring of the EPRC valve 10 has plug in connectors that provide easy connection of the AAR terminal 50.

Figure 3:
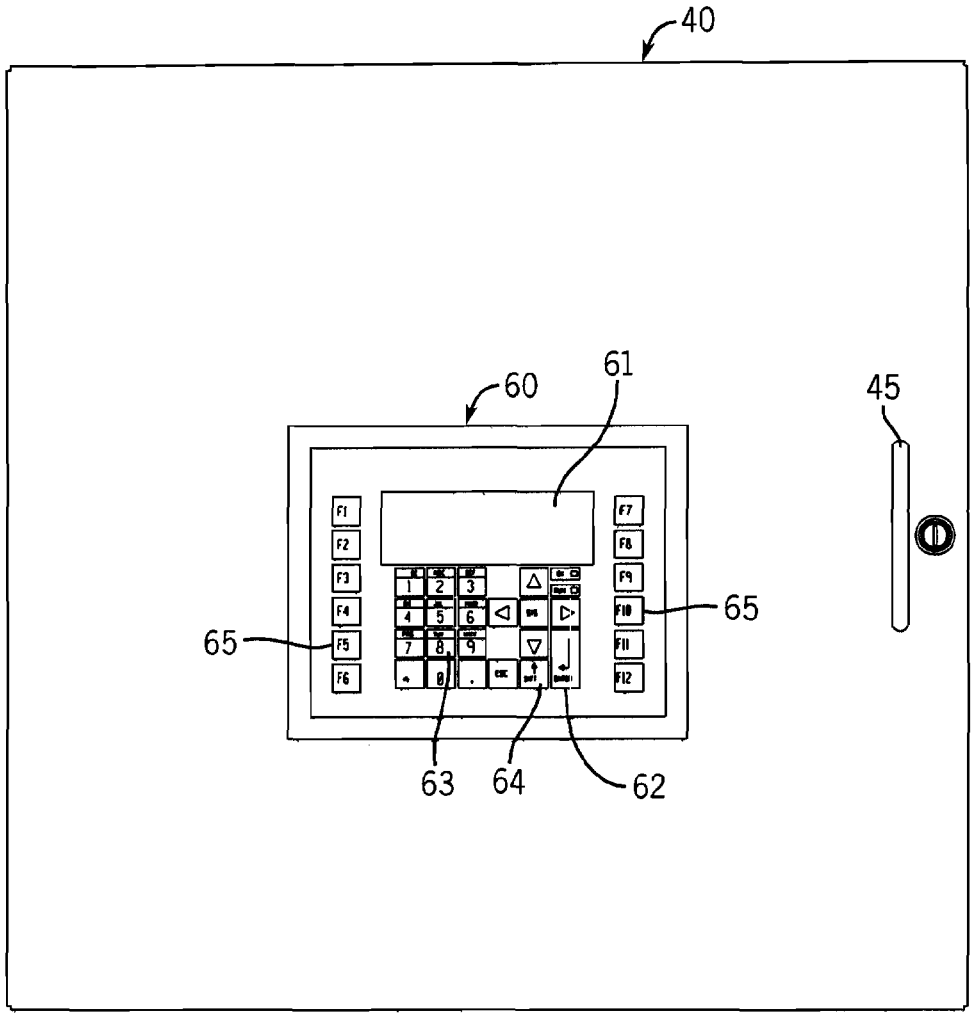
FIG. 3 is a top plan view of the display and control panel.

A user interface or control panel 60 is secured to the upper surface 43 of the access door 40 in enclosure 46. The user interface 60 is used to enter setup data or information and monitor operation of the EPRC valve 10 as discussed below. The upper surface of the control panel 60 is generally flush or even with the remainder of the upper surface 43 of the access door 40. The control panel 60 includes a conventional liquid crystal display 61 and a conventional keyboard 62 with sets of numerical keys 63, operational keys 64 and functional keys 65 as shown in FIG. 3. The control panel 60 includes a circuit board 67 as in FIG. **4*a* that regulates the power supply to the control panel. The circuit board 67 protects the control panel 60 by providing optical isolation of the power, pressure transducer signal and tower signal via components 68 as in FIG. 5. The valve assembly 10 and its control panel 60 are polarity protected and operate satisfactorily when the electric power supply is between 9 to 35 volts. The valve assembly 10 and control panel 60 also operate satisfactorily when outside temperatures are between −44° F. and 150° F. The circuit board 67 is in electrical communication with the programmable logic controller or PLC module 69 shown in FIG. 4. The PLC module 69 includes a processor with an associated memory for storing the operational programming for the EPRC valve 10 and receiving signals and storing the data contained in those signals. As discussed below, FIGS. 17*a-k* show a schematic diagram of the operational programming for the EPRC valve 10**, which is in the ladder language.

The LCD display 61 continually indicates the actual pneumatic pressure inside the retarder as long as the control tower for the yard instructs the EPRC valve 10 to pressurize the retarder when a car passes by the retarder. The control tower can remotely control the valve 10 by pressing the F12 key. The control tower can then set the valve 10 so that the retarder delivers a LIGHT, MEDIUM, HEAVY or EXTRA-HEAVY amount of braking power when a car passes by the retarder. An operator can manually override the valve 10 by pressing the F1-F5 keys. The F1 key sets the valve 10 to pressurize the retarder to a LIGHT (about 20 to 30 psig) amount of braking power. The F2 key sets the valve 10 to pressurize the retarder to a MEDIUM (about 50 to 60 psig) amount of braking power. The F3 and F4 keys set the valve 10 to pressurized the retarder to a HEAVY (about 80 to 90 psig) or EXTRA-HEAVY (120 to 145 psig or full line pressure) amount of braking power, respectively. The F5 key opens or discharges the retarder so that it delivers no braking power. The desired LIGHT, MEDIUM, HEAVY or EXTRA-HEAVY pressure settings can be customized using the numeric keys 63 and pressing one of the operational keys 65.

Figure 9:
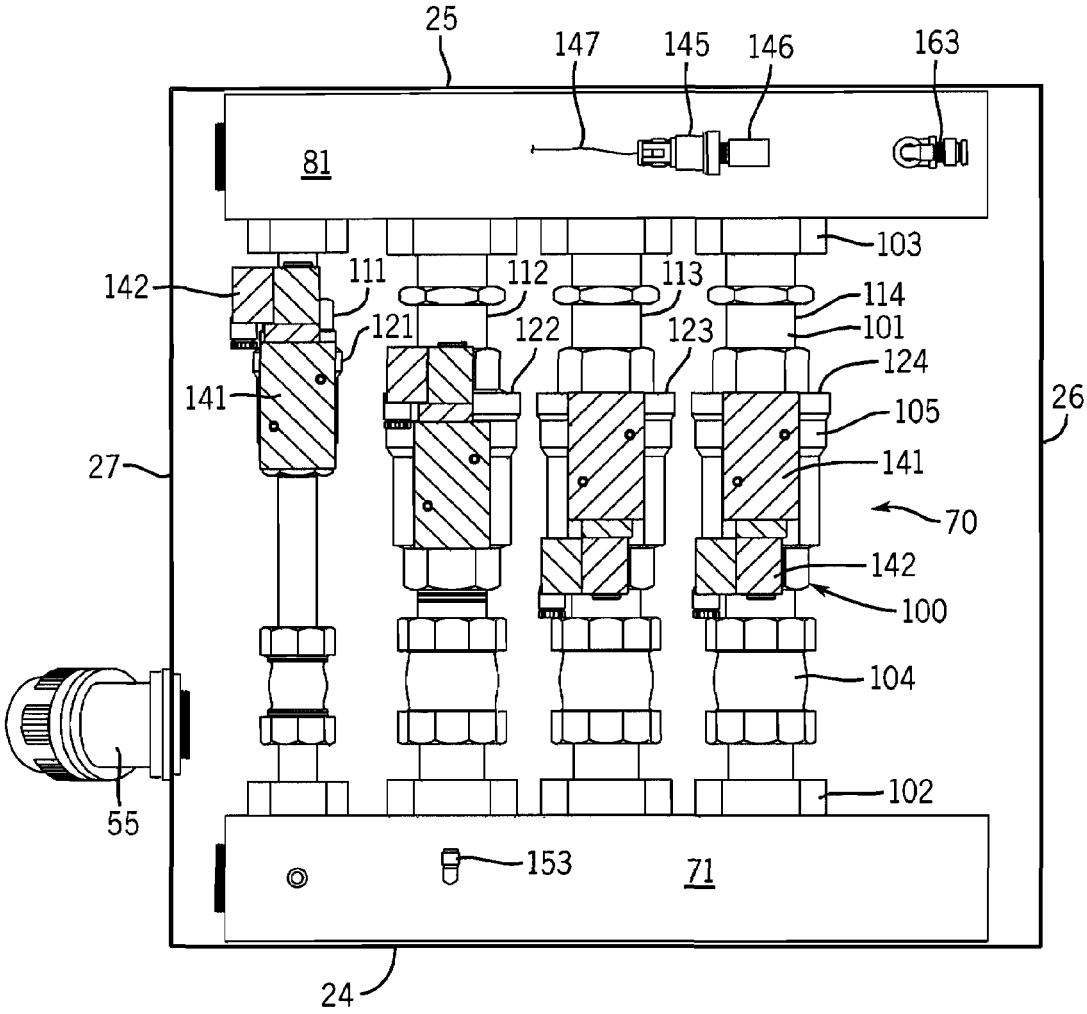
FIG. 9 is a top plan view of the modular control valve assembly.
Figure 10:
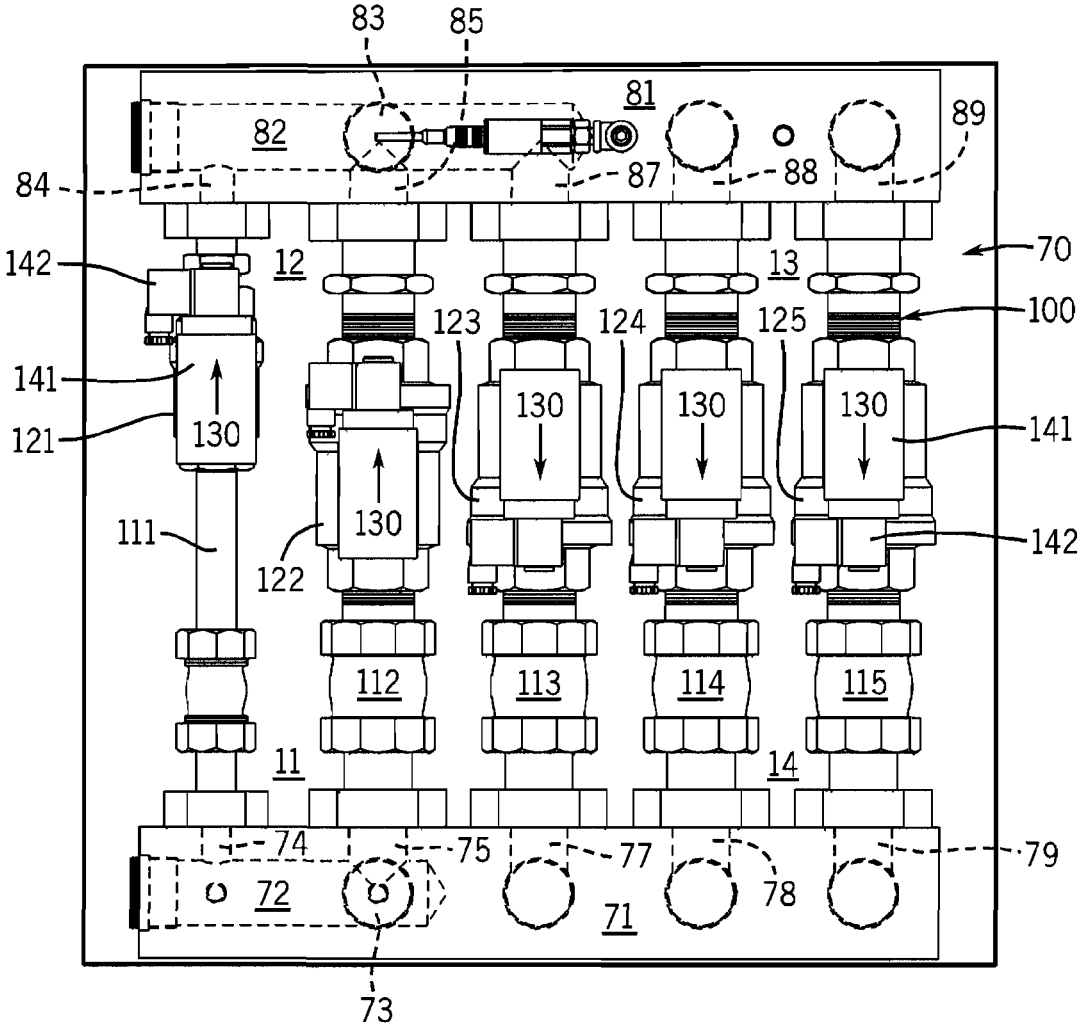
FIG. 10 is a top view of the modular control valve assembly.
Figure 11:
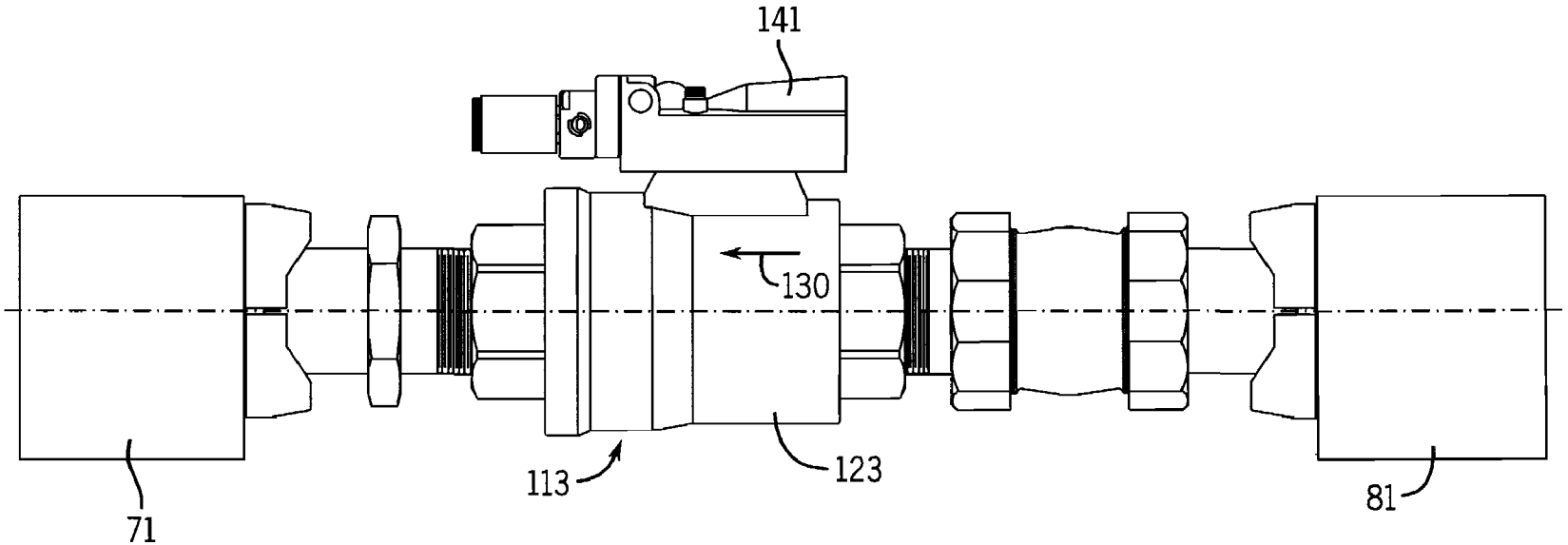
FIG. 11 is a side view of one of one control line and the manifold blocks.
Figure 11A:
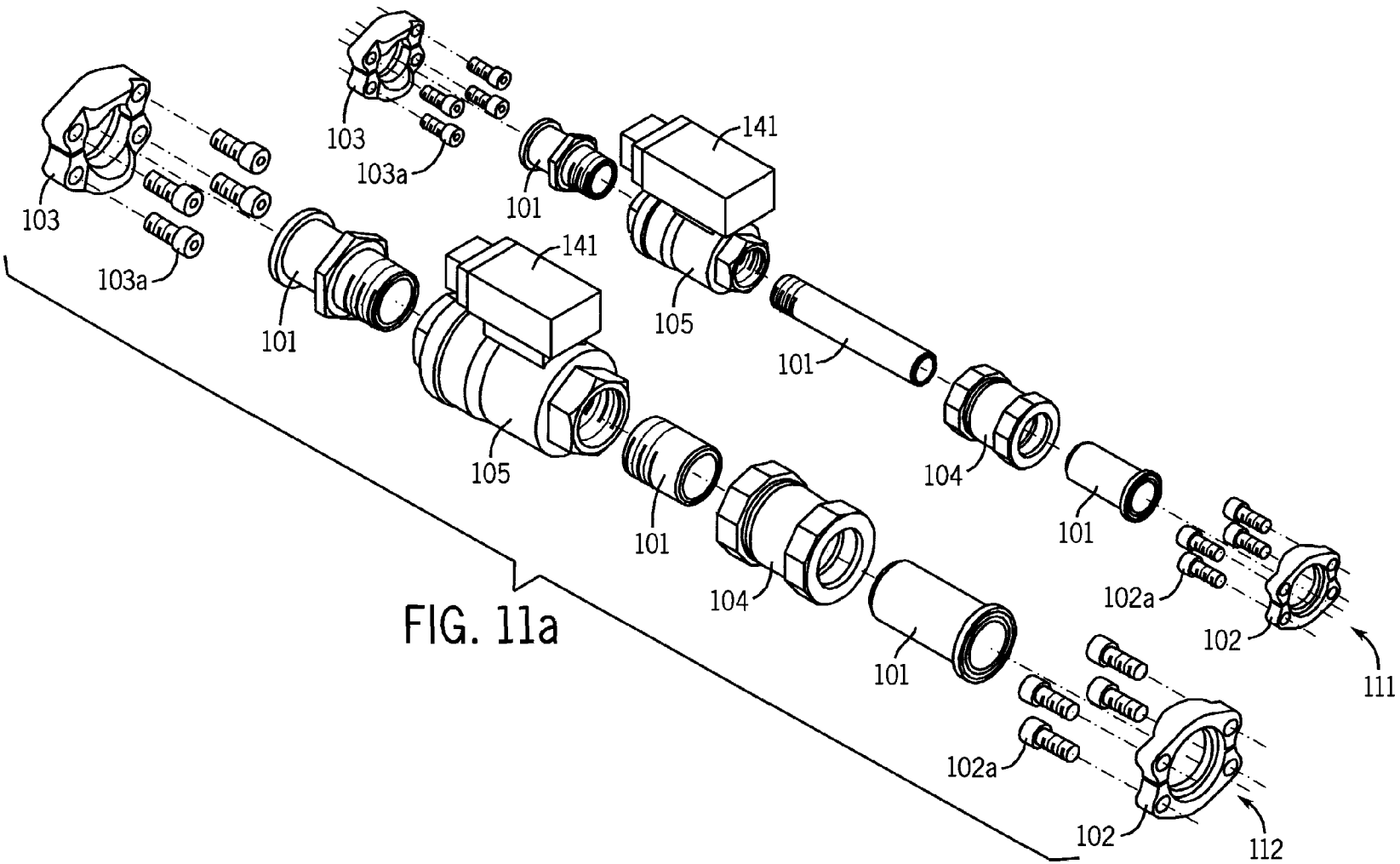
FIG. 11*a* is an exploded perspective view of one of the large and small control lines.
Figure 12:
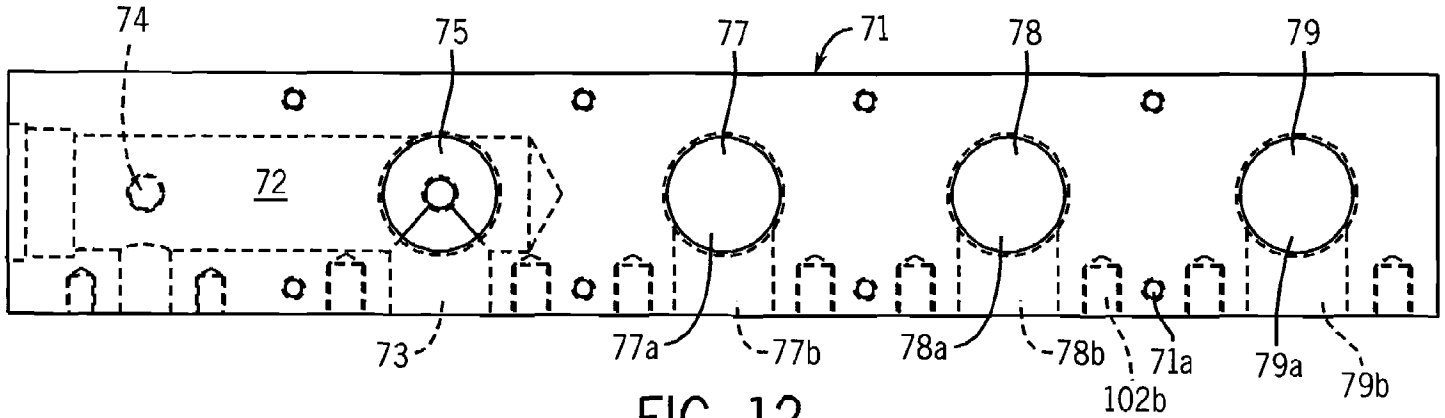
FIG. 12 is a bottom view of the intake and exhaust manifold.
Figure 13:
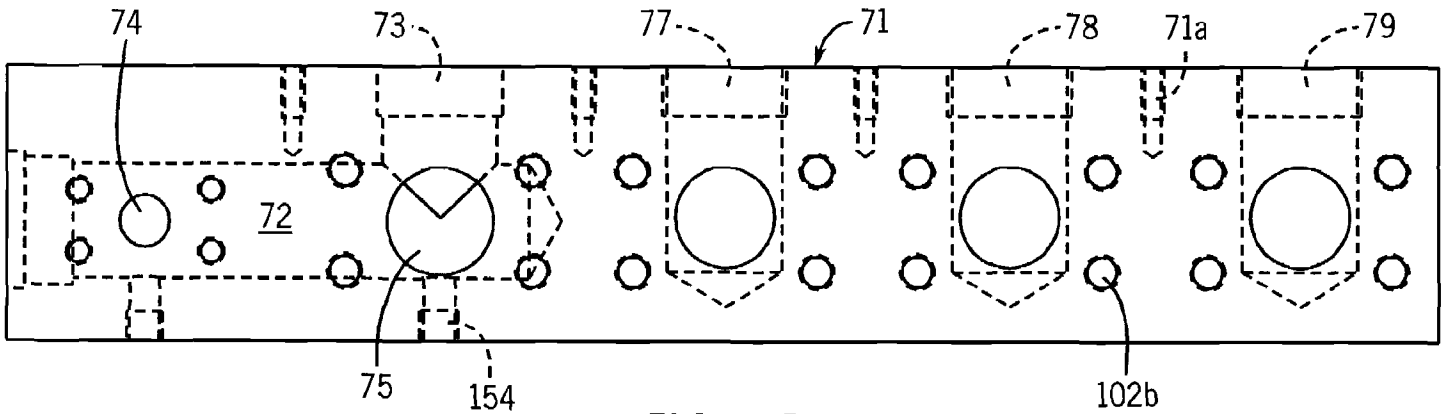
FIG. 13 is a side view of the intake and exhaust manifold.

A modular pressure control assembly or air flow control assembly 70 is housed in the main compartment 29 of the housing 20 as shown in FIGS. 1, 9 and 10. The control assembly 70 operates satisfactorily when compressed air is delivered to the assembly between about 44 to 147 pounds per square inch (psi). The modular control assembly 70 includes a first manifold block 71 as shown in FIGS. 12 and 13. This manifold block 71 takes in pressurized air from the marshalling yard compressed air system. The intake block 71 is rigidly secured along the front wall 24 in the first and fourth areas or quadrants 11 and 14 of the housing 20. This manifold block 71 has eight bolt holes 71*a* for receiving bolts that rigidly secure it to the housing 20. The manifold 71 has a common intake channel 72 that is bored a predetermined longitudinal length through one end of the block. The open end of the channel 72 is then plugged and pneumatically sealed by a cap as shown in FIG. 9. The common intake channel 72 is in pneumatic communication with an air intake passage 73 that is bored through the bottom of the manifold block 71, and first and second supply line passages 74 and 75 that are bored through the side of the manifold block.

The manifold block 71 preferably exhausts discharged or return air from the retarder as discussed below, and is preferably an integral piece of metal that forms a combined intake/exhaust manifold block. As such, the manifold block 71 includes first, second and third exhaust passages 77-79 for exhausting pressurized air from the retarder to ambient outside air. Each exhaust passage 77, 78 and 79 includes a first portion 77*a*, 78*a* or 79*a* that is bored through the bottom of the block 71, and a second portion 77*b*, 78*b* or 79*b* that is bored through the side of the block. Each first portion or bore is in pneumatic communication with and intersects its respective second bore at a right angle. A common exhaust channel (not shown) may be provided to pneumatically join the exhaust passages 77-79. The bores 74, 75, 77*b*, 78*b* and 79*b* for the supply and exhaust passages are each spaced apart a predetermined distance from its adjacent bores.

Figure 14:
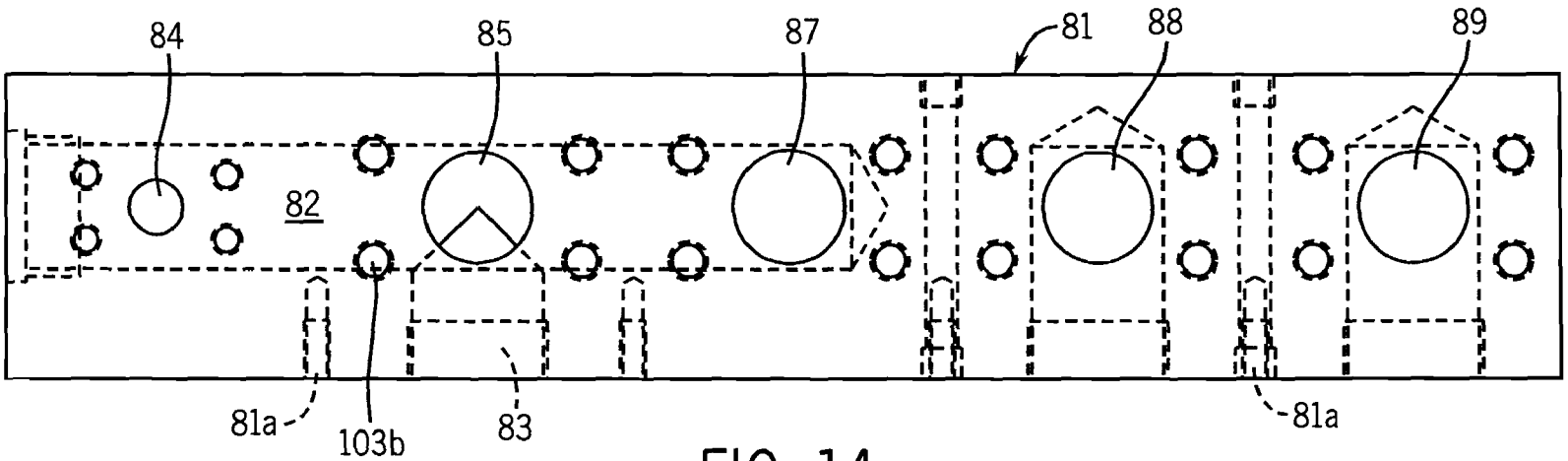
FIG. 14 is a side view of the retarder supply and return manifold.
Figure 15:
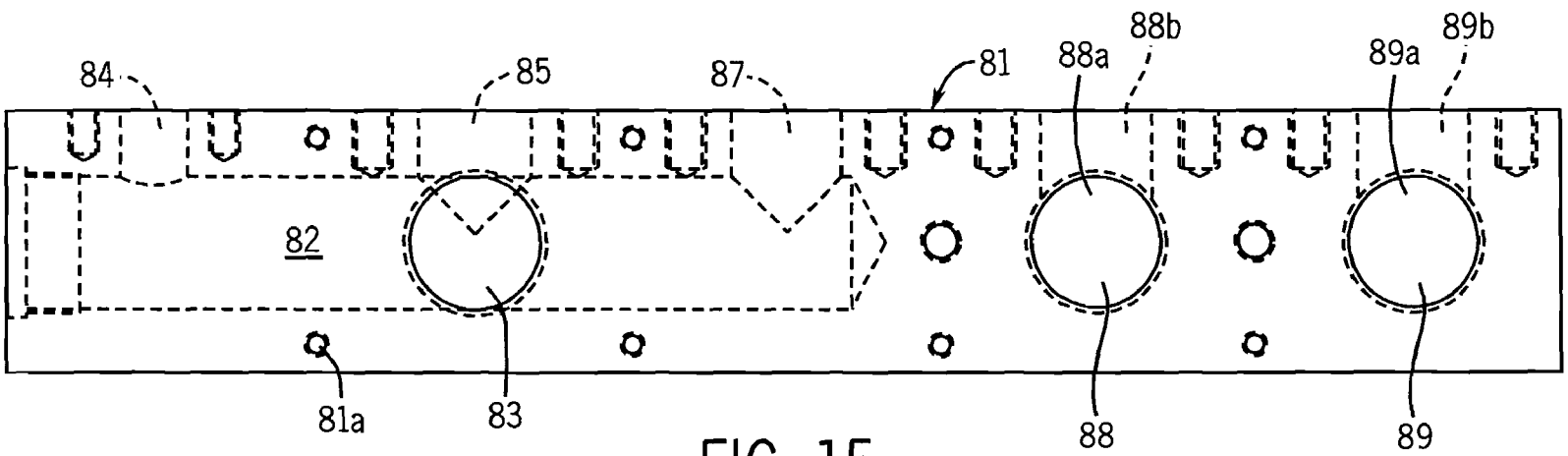
FIG. 15 is a bottom view of the retarder supply and return manifold.

The modular pressure control assembly 70 includes a second manifold block 81 as shown in FIGS. 14 and 15. This manifold block 81 supplies pressurized air to the retarder. The manifold block 81 is positioned along the rear wall 25 in the second and third areas or quadrants 12 and 13 of the housing 20. The supply block 81 includes eight bolt holes 81*a* for receiving bolts that rigidly secure it to the housing 20. The manifold 81 has a common retarder supply channel 82 that is bored a predetermined longitudinal length through one end of the block. The open end of the channel 82 is then plugged and pneumatically sealed by a cap as shown in FIG. 9. The common supply channel 82 is in pneumatic communication with a retarder supply passage 83 that is bored through the bottom of the block, and first and second supply line passages 84 and 85 and a first discharge passage 87 that are bored through the side of the block.

The manifold block 81 preferably receives discharged air from the retarder, and is an integral piece of metal that forms a combined supply/return manifold block. As such, the manifold block 81 includes second and third return passages 88 and 89 that are bored through the bottom surface of the block. Each return passage 88 and 89 includes a first portion 88*a* or 89*a* that is bored through the bottom of the block 81, and a second portion 88*b* or 89*b* that is bored through the side of the block. Each first portion or bore is in pneumatic communication with and intersects its respective second bore at a right angle. A common exhaust channel (not shown) may be provided to pneumatically join the exhaust passages 88 and 89. The bores 84, 85, 87, 88*b* and 89*b* for the supply and return passages are each spaced apart a predetermined distance from its adjacent bores.

Although the manifolds 71 and 81 are each shown and described to be integral blocks of metal that are bolted to the housing, it should be understood that the broad aspects of the invention are not limit a particular manifold shape or form of securement. The manifolds 71 and 81 could be integrally formed with the housing or welded to the housing. Similarly, each manifold could be formed by two of more separate components. For example, the intake/exhaust manifold 71 could be formed by two or more components located along the first and second areas or quadrants 11 and 12, and the supply/return manifold 81 could be formed by two or more components located along the second and third areas or quadrants 13 and 14.

Figure 6:
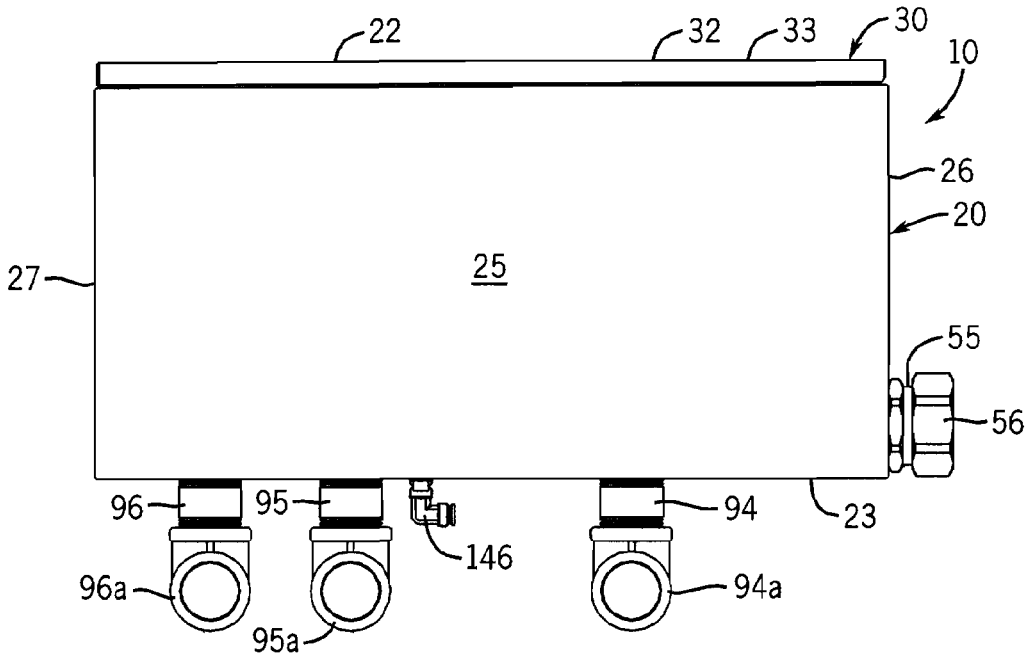
FIG. 6 is a rear view of the EPRC valve in its housing.
Figure 7:
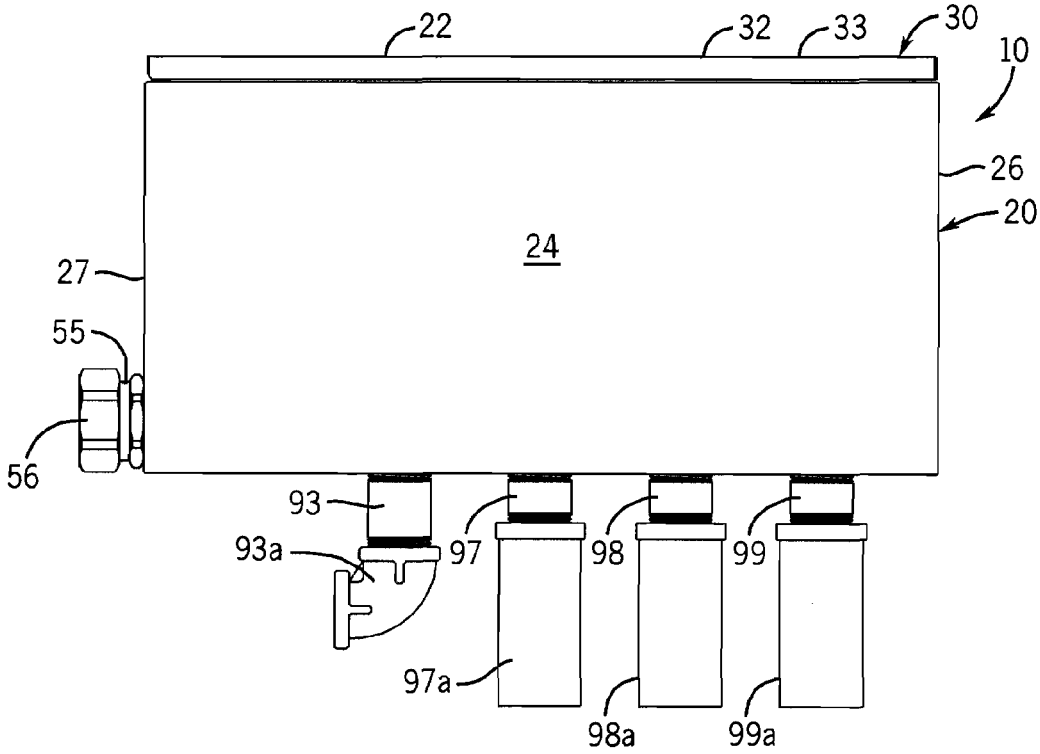
FIG. 7 is a front view of the EPRC valve in its housing.
Figure 8:
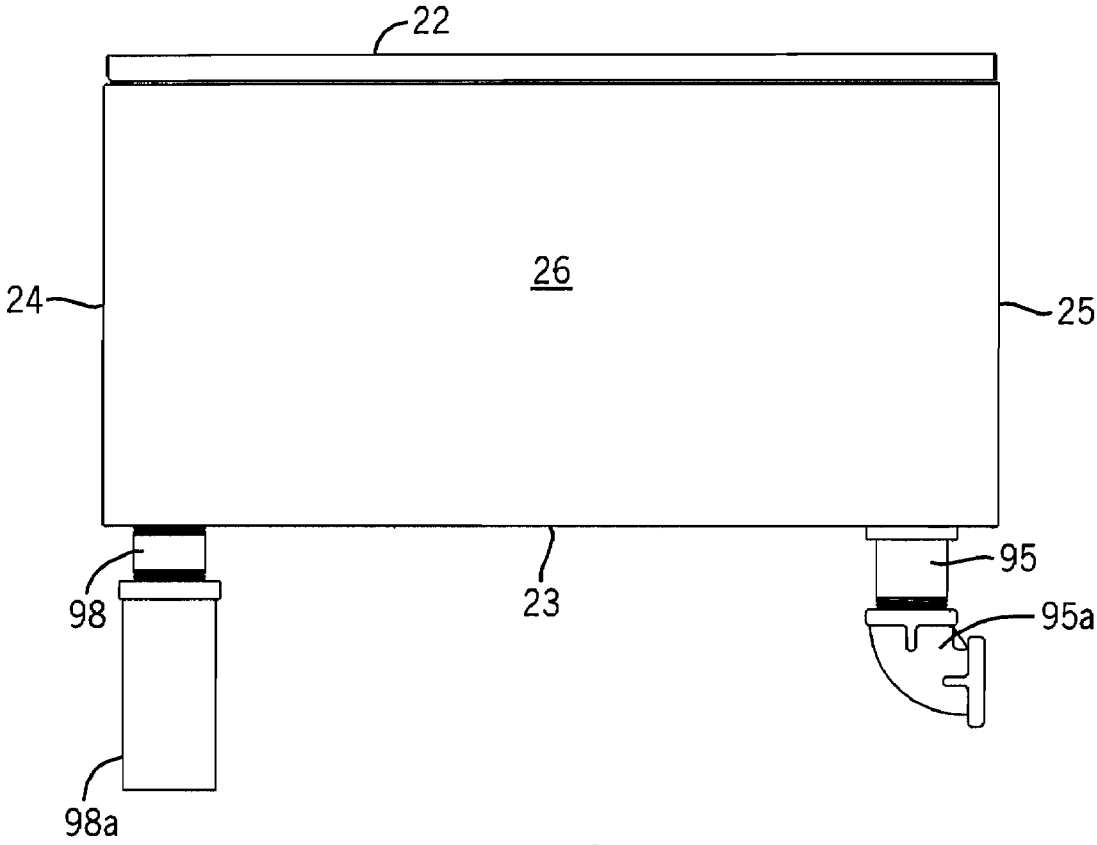
FIG. 8 is a side view of the EPRC valve in its housing.

External connections 93, 94, 95, 97, 98 and 99 are connected to the manifold blocks 71 and 81 that extend from the exterior surface of the housing 20 as shown in FIGS. 6-9. An air intake connection 93 passes through an opening in the bottom 23 of the housing 20 and into the air intake bore 73 of manifold 71 as shown in FIG. 7. Pressurized air supplied from the railroad yard compressor (not shown) passes through the air intake connection 93 and bore 73 and into the common intake channel 72. The pressure of the common intake channel 72 is generally at about 120 psi pressure set by the yard compressor system. A retarder supply connection 94 passes through an opening in the bottom 23 of the housing toward the rear wall 25 as shown in FIG. 6. The retarder supply connection 94 is joined to and is in pneumatic communication with the retarder supply bore 83 and the common channel 82. The retarder supply connection 94 delivers pressurized air to the retarder until the retarder is at the desired pressure entered into the control panel 60. Supply connection 94 can also be used to vent air through bore 87. A retarder return connection 95 passes through the housing 20 and is joined to and in pneumatic communication with the second discharge bore 88. Air being discharged from the retarder to release its brake mechanism is discharged into retarder connection 95 and second discharge bore 88. The air being discharged from the retarder can also be routed through an additional return line to a second retarder return connection that is joined to and pneumatically in communication with the third discharge bore 89. Three air exhaust connections 97, 98 and 99 are joined to and in pneumatic communication with exhaust bores 77, 78 and 79, respectively. Intake connection 93, supply/return connection 94 and return connections 95 and 96 include a ninety degree elbow 93*a*, 94*a*, 95*a* or 96*a*. Each exhaust connection 97-99 includes a muffler 97*a*, 98*a* or 99*a*. As shown in FIG. 2 a three-sided shield (not shown) is provided to protect field personnel from the exhaust air.

A number of control lines 100 extend between the intake and exhaust manifold block 71 and the retarder supply and discharge manifold block 81. Each control line 100 has the same overall length, has a similar in-line shape and includes similar or like-shaped components. Each control line 100 includes piping 101, first and second couplings 102 and 103, an expansion joint 104 and a valve 105. Each coupling 102 and 103 includes bolts 102*a* or 103*a* that rigidly secure the line to the manifolds 71 and 81 via their bolt holes 102*b* or 103*b*, respectively. Two control lines 100 are supply lines 111 and 112. Supply line 111 is in pneumatic communication with the first supply line bores 74 and 84 of the manifolds 71 and 81, respectively. Supply line 112 is in pneumatic communication with second supply line bores 75 and 85. Supply line 111 has similar but smaller diameter components 101-105 than those in lines 112-115. The smaller line 111 has a diameter of ¾ inches and the larger line 112 has a diameter of 1½ inches. Discharge lines 113, 114 and 115 also extend between the intake and exhaust manifold block 71 and the retarder supply and discharge manifold block 81. The discharge lines 113-114 have identical components 101-105 and an equivalent length to the supply line 112. Lines 112-115 are interchangeable, and have a diameter of 1½ inches. Discharge line 113 is in pneumatic communication with exhaust bores 77 and 87. Discharge line 114 is in pneumatic communication with exhaust bores 78 and 88. The optional third discharge line 115 is in pneumatic communication with discharge bores 79 and 89.

The programmable logic controller or PLC module 69 of the control panel 60 regulates the volumetric delivery of air to the retarder by controlling the flow of air through the smaller and larger supply lines 111 and 112. When both supply lines 111 and 112 are closed, no pressurized air is delivered to the retarder. When only the smaller supply line 111 is open, pressurized air is delivered to the retarder at a smaller volumetric rate. The smaller supply line 111 increases the actual pressure in the retarder more slowly so that the control valve 10 has more control over the actual pressure in the retarder valve. This helps prevent the control valve 10 from overshooting this relatively low or light desired pressure. Only the smaller supply line 111 is typically opened to pressurize the retarder to a LIGHT (about 20 to 30 psig) or MEDIUM (about 50 to 60 psig) weight class or amount of actual pressure or braking power. The volumetric rate of flow of pressurized air to the retarder increases when the larger supply line 112 is open and the smaller supply line 111 is closed. An even greater volumetric rate of flow of pressurized air is delivered to the retarder when both supply lines 111 and 112 are opened. Only the large supply line 112 is typically opened to pressurize the retarder to a HEAVY (about 80 to 90 psig) or EXTRA-HEAVY (about 120 to 145 psig) weight class. The selected weight class dictates the amount of actual pressure or braking power supplied by the EPRC valve to the expandable cylinders in the retarder. The preferred PLC module 69 is made by Homer Electric of CIMTEC Automation and Control of Charlotte, N.C. and sold as Part No. HE500OCS210.

Each control line 111-115 includes a conventional pneumatically operated valve 121-125. The valves 121-125 are designed to allow the pressurized air to flow through them in a particular direction 130. Supply lines 111 and 112 have their supply valve 121 and 122 facing so that compressed air can flow from the common intake chamber 72 in the intake and exhaust manifold block 71 to the common supply chamber 82 in retarder supply and return manifold block 81. Although discharge lines 113-115 are interchangeable with supply line 112, they have their discharge valves 123-125 facing in an opposite direction so that air flows from the return side of the supply and return manifold block 81 to the exhaust side of the intake and exhaust manifold 71 block as shown in FIGS. 9 and 10. Each line 101-105 could be replaced by a pre-assembled like line formed by the same components 101-105 and adjusting expansion joint 104 to accommodate its precise fitting and connection between the manifold blocks 71 and 81.

Figure 4:
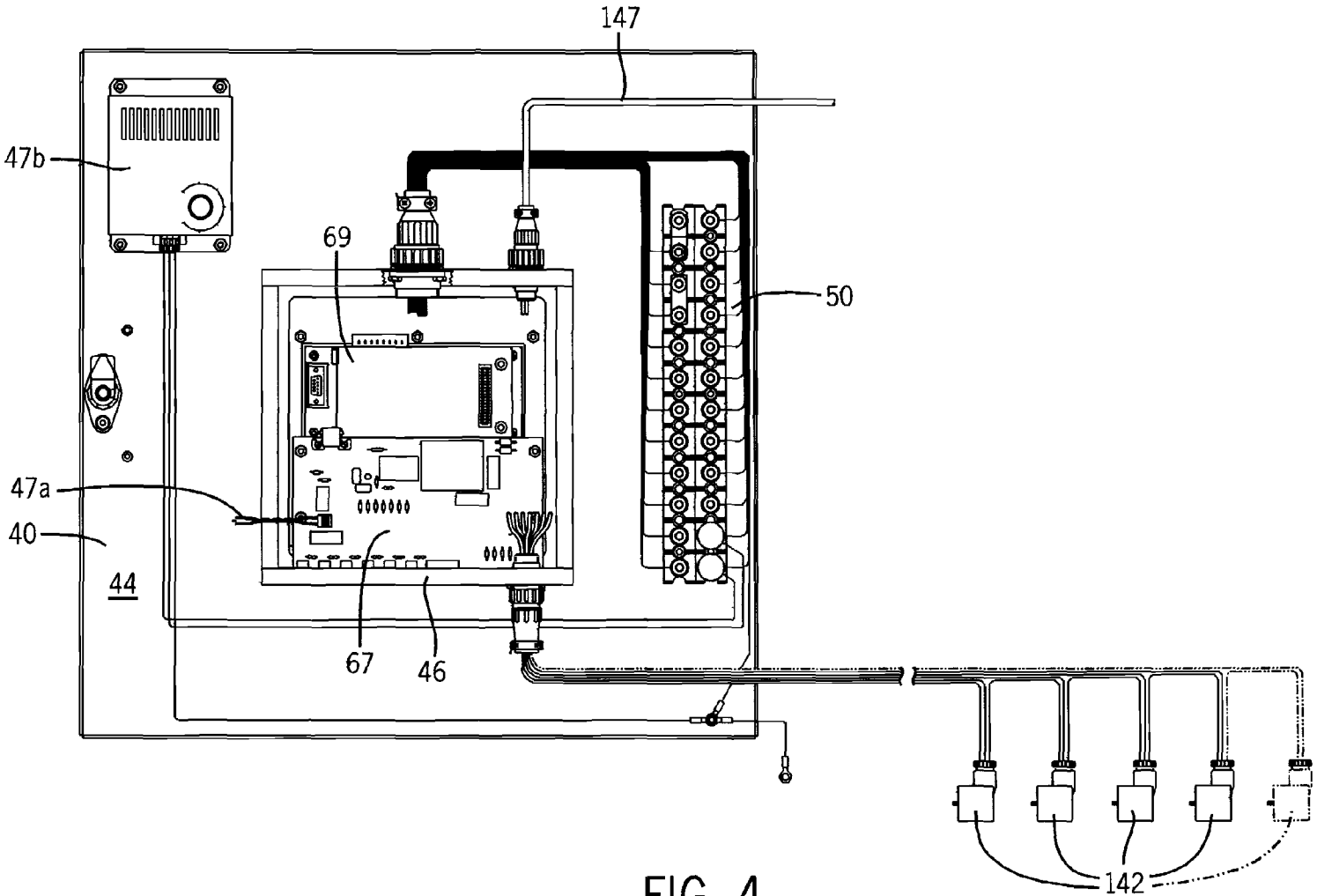
FIG. 4 shows the underside of the interior door, the PLC module and circuit board of the control panel, and main EPRC heater.
Figure 4A:
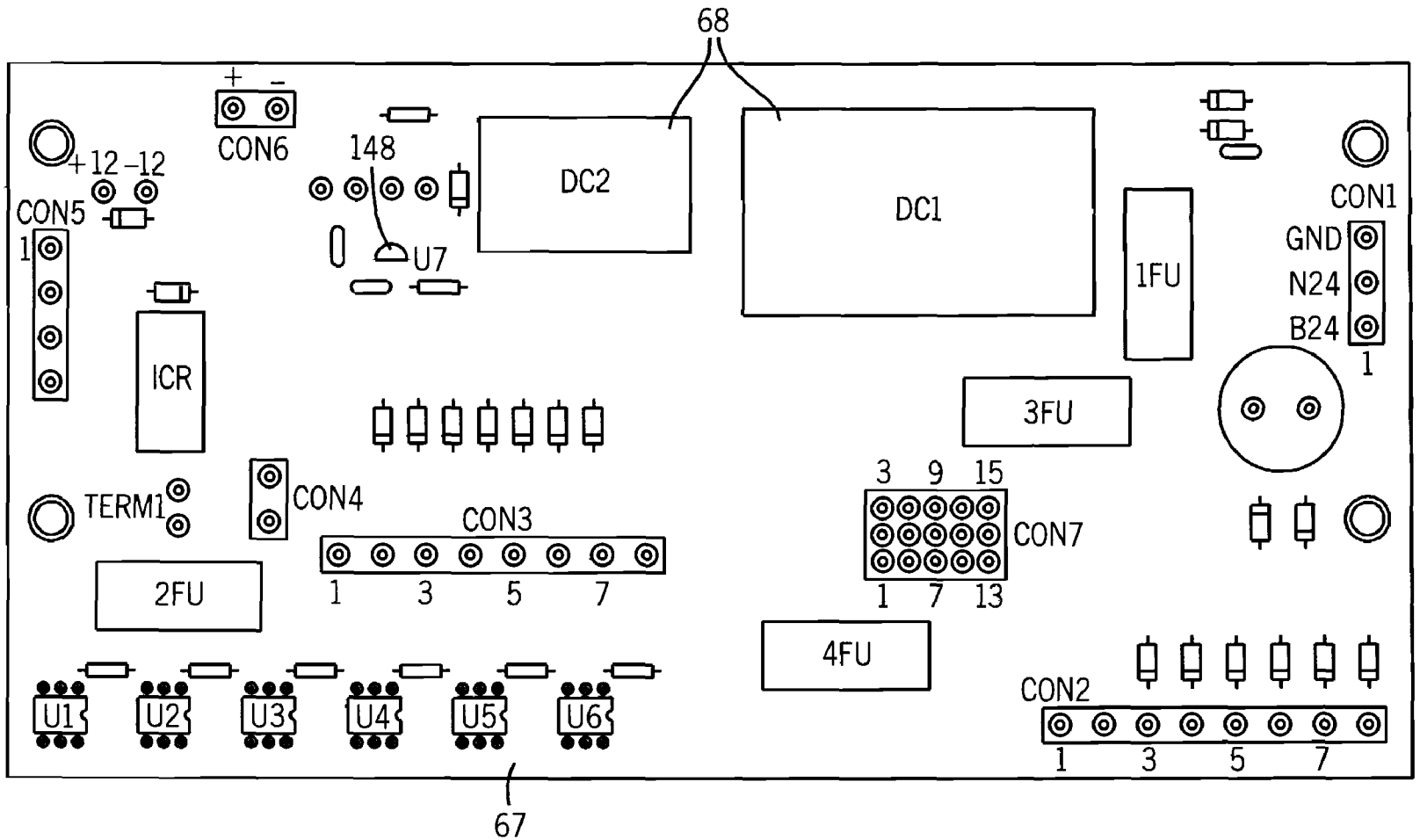
FIG. 4*a* is a top plan view of the circuit board of the control panel.
Figure 5:
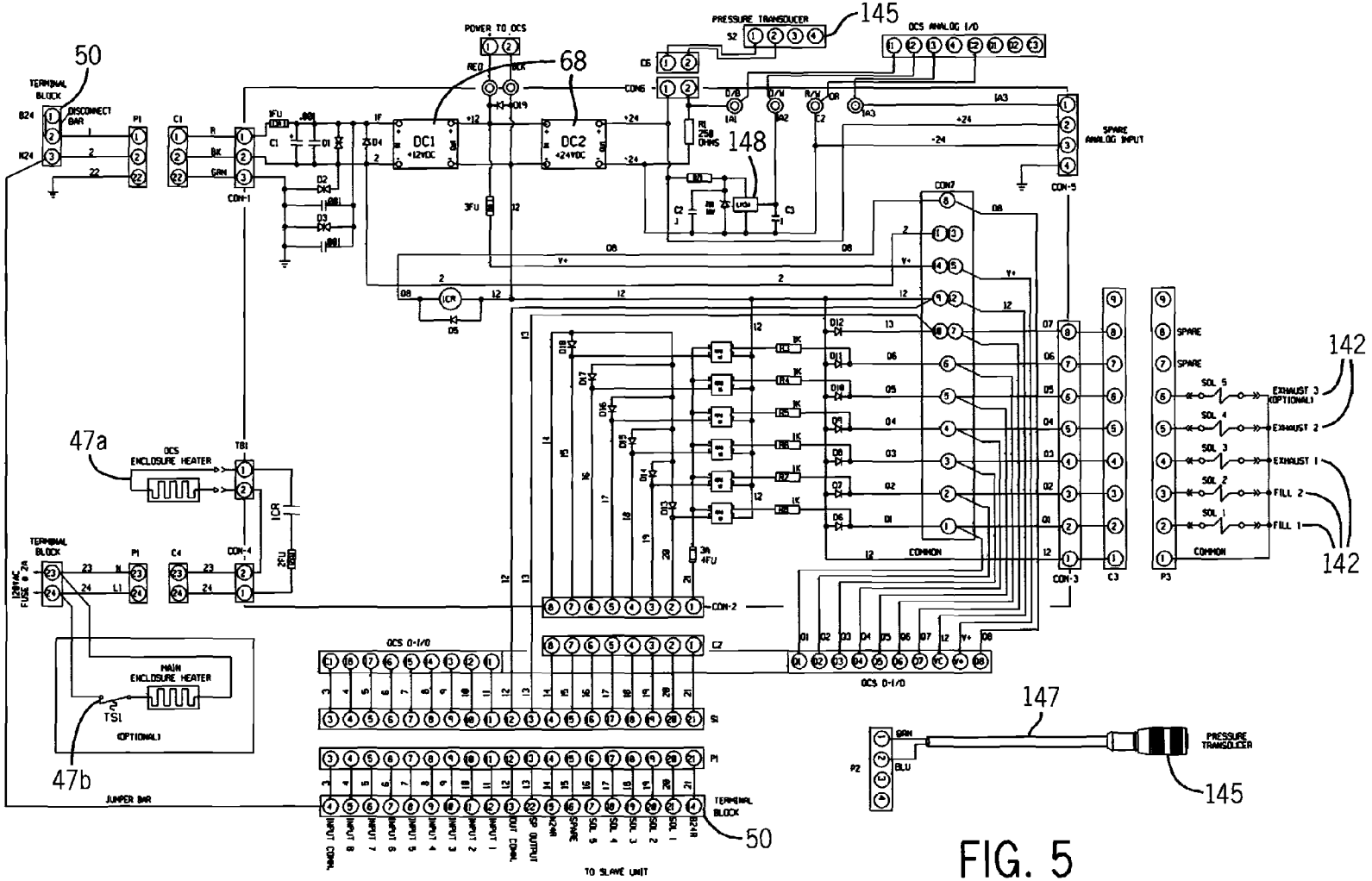
FIG. 5 is an electrical schematic showing the electric power supply to the control panel, pressure transducer, control valves and heater.
Figure 16:
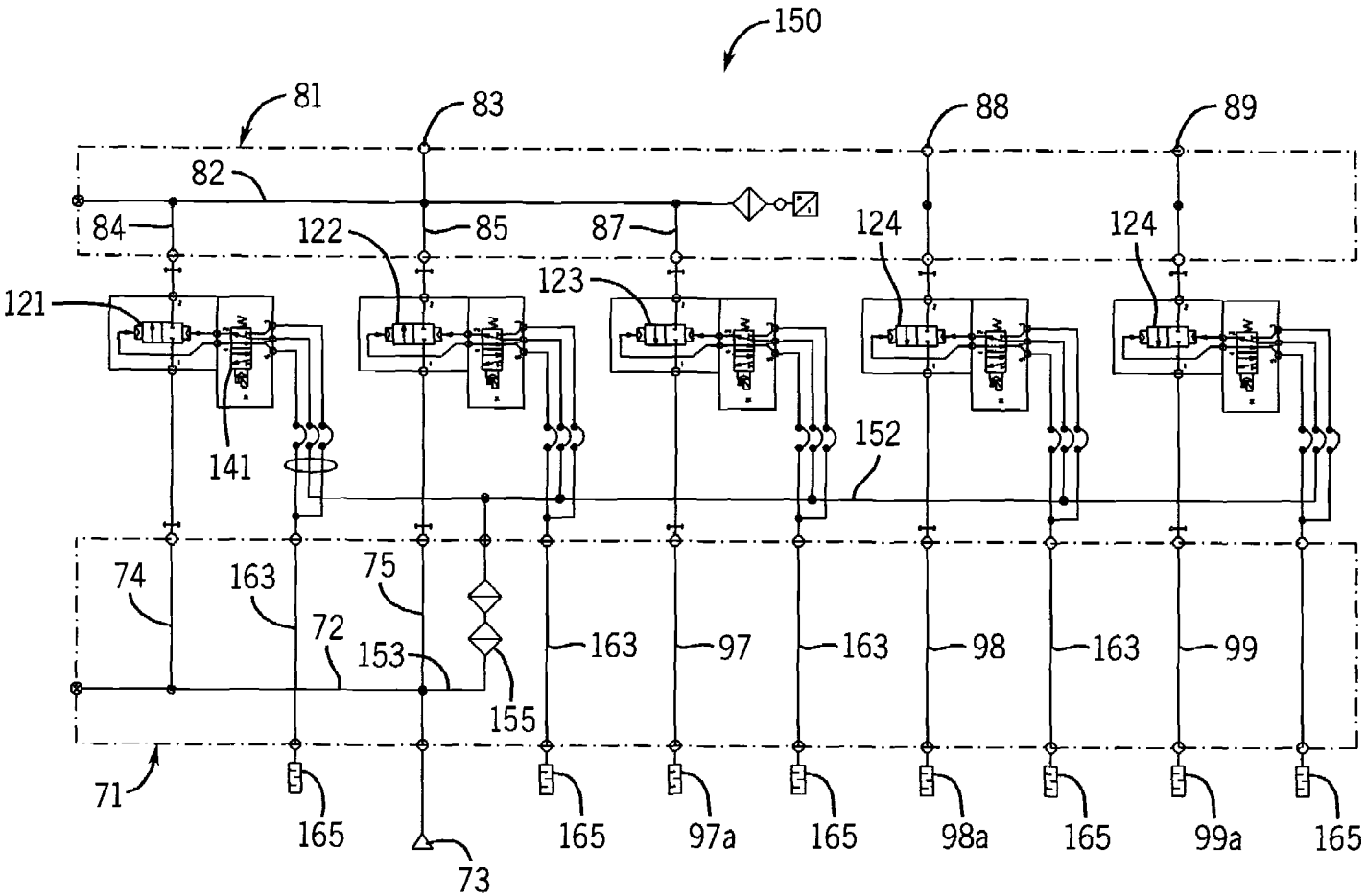
FIG. 16 is a pneumatic schematic for the control valves and their associated pilot valves.

Each valve 121-125 is controlled by a separate pilot air valve 141 as shown in FIGS. 10 and 16. Each pilot air valve 141 has an electric solenoid 142 that is controlled by the central processing unit of the programmed logic controller 69 in the control panel 60 as shown in FIG. 4. The pilot air valve 141 and solenoid 142 work in combination to direct pressurized pilot air to one of two sides of a piston in its corresponding valve 121-125 to move that valve into either an open or close position. The pilot air vales 141 and solenoids 142 are preferably manufactured by Festo Corporation of Germany as Model Number MFH-5-1/4-MA. Each valve 121-125 is either open or closed. When either or both valves 121 and 122 of supply lines 111 or 112 are open, then the valves 123-125 of discharge lines 113-115 are closed. This delivers pressurized air to the retarder. Pressurized air is delivered to the retarder until the pressure in the cylinders of the retarder reach the pre-established pressure for the desired light, medium, heavy or extra heavy braking power setting. Actual pressure in the retarder is pneumatically communicated via a tube 146 to a pressure transducer 145 mounted on manifold block 81.

The pressure transducer 145 monitors the pressure in the retarder cylinders. The pressure transducer 145 is located in the main compartment 29 of the housing 20, and is connected to and in pneumatic communication with the retarder cylinder via a ⅜ inch hose. The retarder cylinder reservoir dampens the reaction of the transducer 145 when sudden changes in air pressure occur. The transducer 145 converts the pressure to a corresponding 4 to 20 mA electric signal that is sent via a wire 147 to the processor of the PLC module 69 located in the control panel 60. The pressure transducer 145 is capable of measuring between 0 to 145 psi, which is greater than the yard compressed air system. The signal sent to the PLC module 69 is directly proportional to the air pressure in the retarder cylinder. The transducer 145 sends a 4 mA signal when there is zero pressure in the cylinder. Bach additional 1 mA signal strength is equal to about 9 psi more air pressure in the cylinder. In this way, the PLC module 69 is constantly receiving actual pressure data from the retarder to compare to the stored upper and lower pressure limit setting (20 to 30 psig, 50 to 60 psig, 80 to 90 psig, or 120 to 145 psig) for the currently selected braking power or weight class setting (LIGHT, MEDIUM, HEAVY or EXTRA-HEAVY). The programmed processor 69 will then open and close the inlet and exhaust valves 121-125 to ensure that the retarder pressure stays within the desired weight class specification. If desired, the EPRC valve 10 can be configured to send the 4 to 20 mA signal of the transducer 145 directly to the yard's computer system.

When the actual pressure in the retarder as measured by the transducer 145 reaches the pre-established or desired amount of pressure (LIGHT, MEDIUM, HEAVY or EXTRA-HEAVY braking power) stored in the memory associated with the processor of the PLC module 69, the programmed processor causes the solenoid 142 and pilot valve 141 to close valves 121 and 122 to stop further delivery of pressurized air to the retarder. When all the valves 121-125 are closed, the pressurized air in the retarder is retained and the pressure is maintained at that actual pressure. Should the processor of the PLC module 69 detect via the pressure transducer 145 that the actual pressure in the retarder has dropped due to a leak in the retarder or the supply lines to the retarder, one or both valves 121 and 122 of supply lines 111 and 112 can be reopened to elevate the actual pressure back to the desired pressure. The valves 123-125 of discharge lines 113-115 are opened to discharge the pressurized air in the retarder so that the retarder is in an open or non-braking position. The pressurized air in the supply line to the retarder is exhausted through discharge line 113 and muffler 97*a*. The discharge line or lines of the retarder are exhausted through discharge lines 114 or 115 and corresponding mufflers 98*a* or 99*a*.

A conventional pilot air assembly 150 is used in combination with the pilot valve 141 and solenoid 142 to control the opening and closing operation of the valves 121-125 as shown in FIG. 16. The pilot air assembly 150 includes an air intake line or tube 152 with an intake port 153 secured to a passage or bore 154 in manifold 71. The intake line 152 is in pneumatic communication and takes pressurized pilot air from the common intake channel 72 to open and close the valves 121-125. The intake line 152 includes a set of filters 155 for removing impurities before the pilot air header branches off to the five pilot valves 141. A branch of the air intake line 152 is pneumatically connected to an intake port of each pilot valve 141. The pilot air assembly 150 also includes an air exhaust line or tubing 163 connected to an outlet port for each pilot valve 141, which is exhausted to ambient outside air. Each exhaust line 163 includes an exhaust filter 165 that prevents moisture, dust and insects from entering into the pneumatic control assembly 150. Although not shown, the exhaust tubing 163 can feed into a common header prior to exhausting to ambient outside air.

Setup and Operation

An operating program is downloaded or otherwise entered into the associated memory of the PCL module 69 during assembly. When the installed program is booted-up or uploaded, the control panel 60 is used to load default variables, such as the number of exhaust valves, the temperature to trigger heater operation, upper and lower pressure limits for each weight class. The program allows these values to be accessed, entered or modified via the user interface 60 so that personnel at a given railroad marshalling yard can customize these variables for their yard and desired operation. Still, these values are initially loaded during assembly so that manufacturing and quality personnel can verify operation of the EPRC valve 10 and so that field personnel can operate the unit 10 prior to entering their specific information.

Figure 17A:
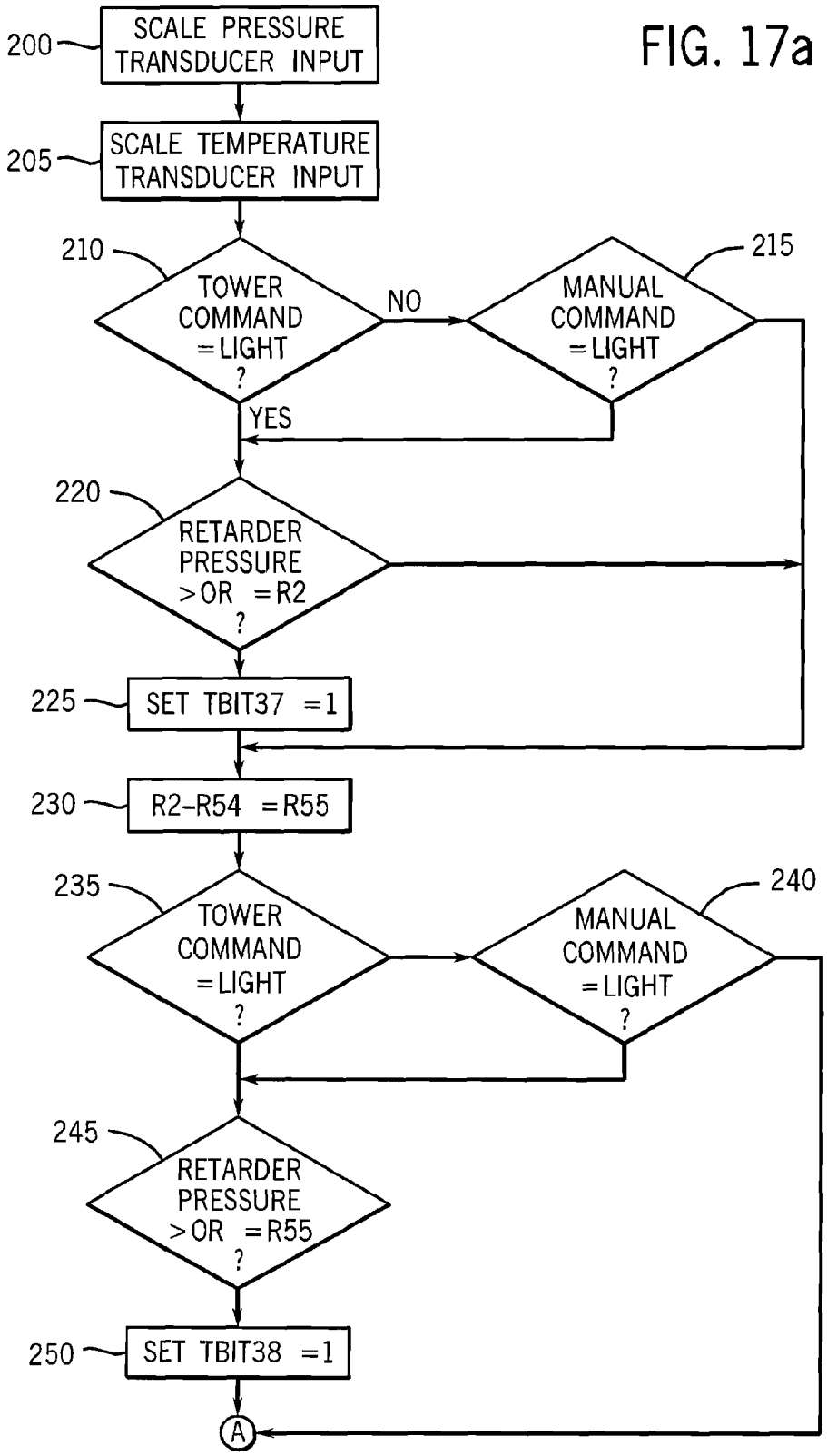
Figure 17B:
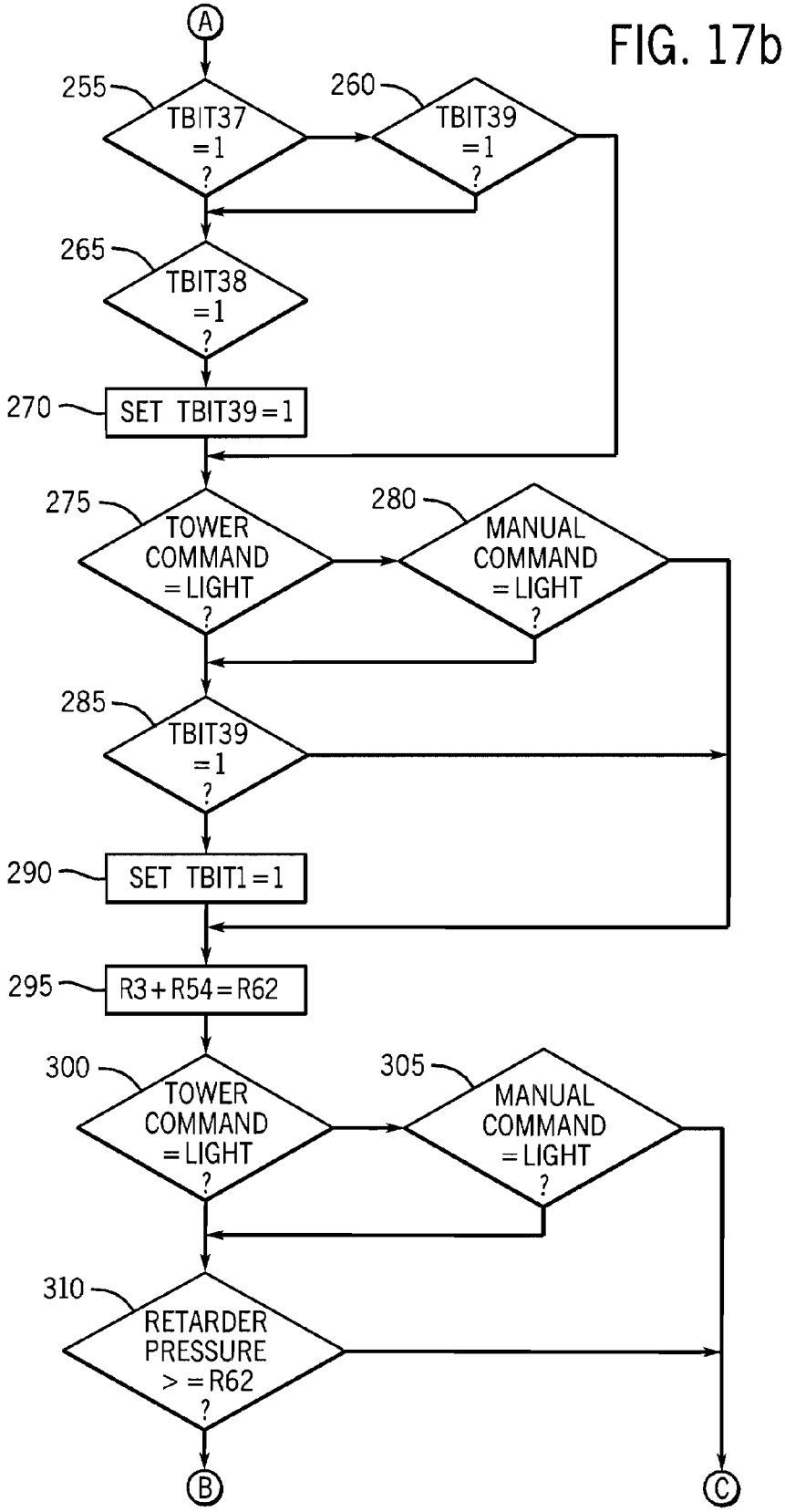
Figure 17C:
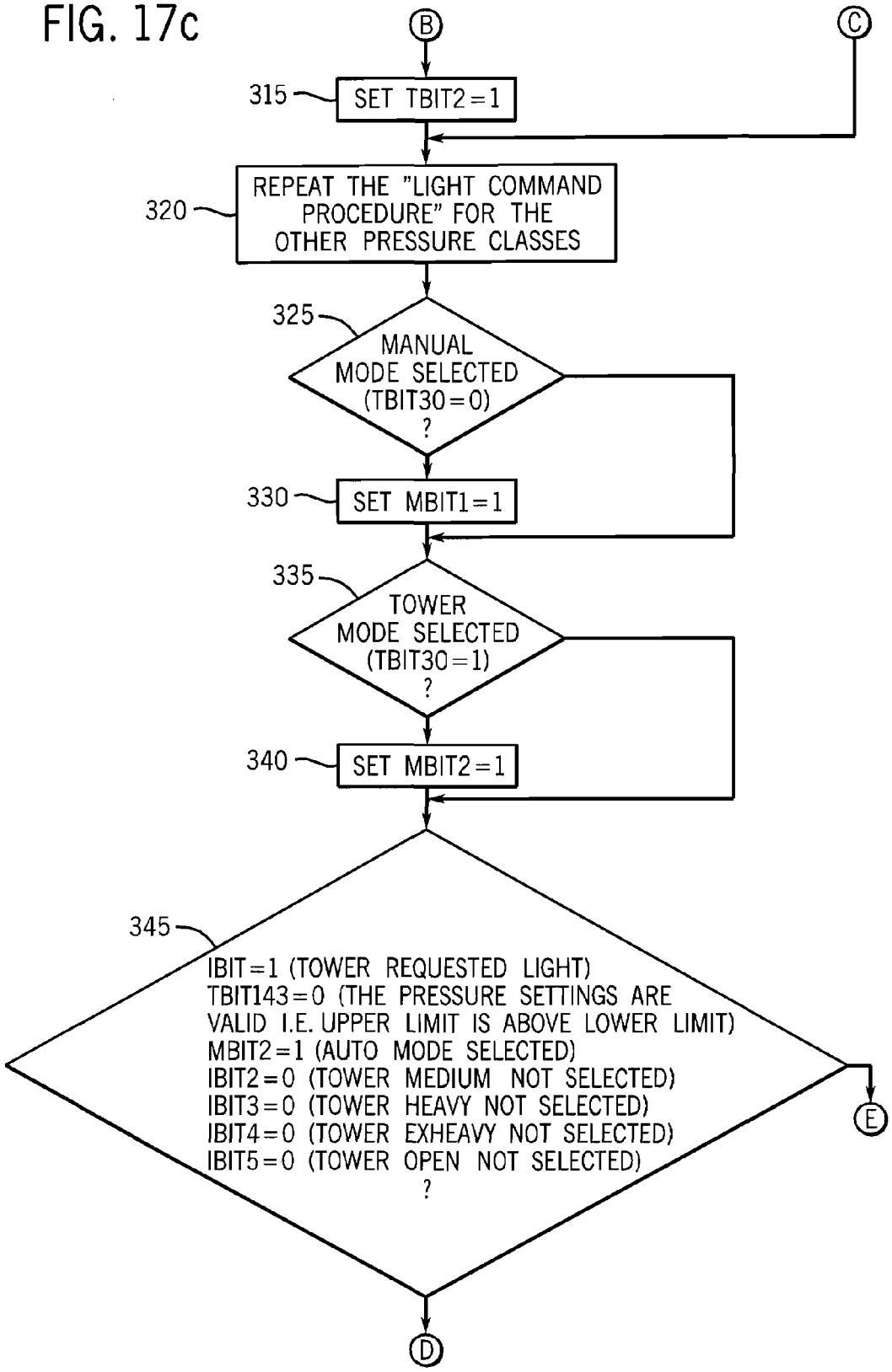
Figure 17D:
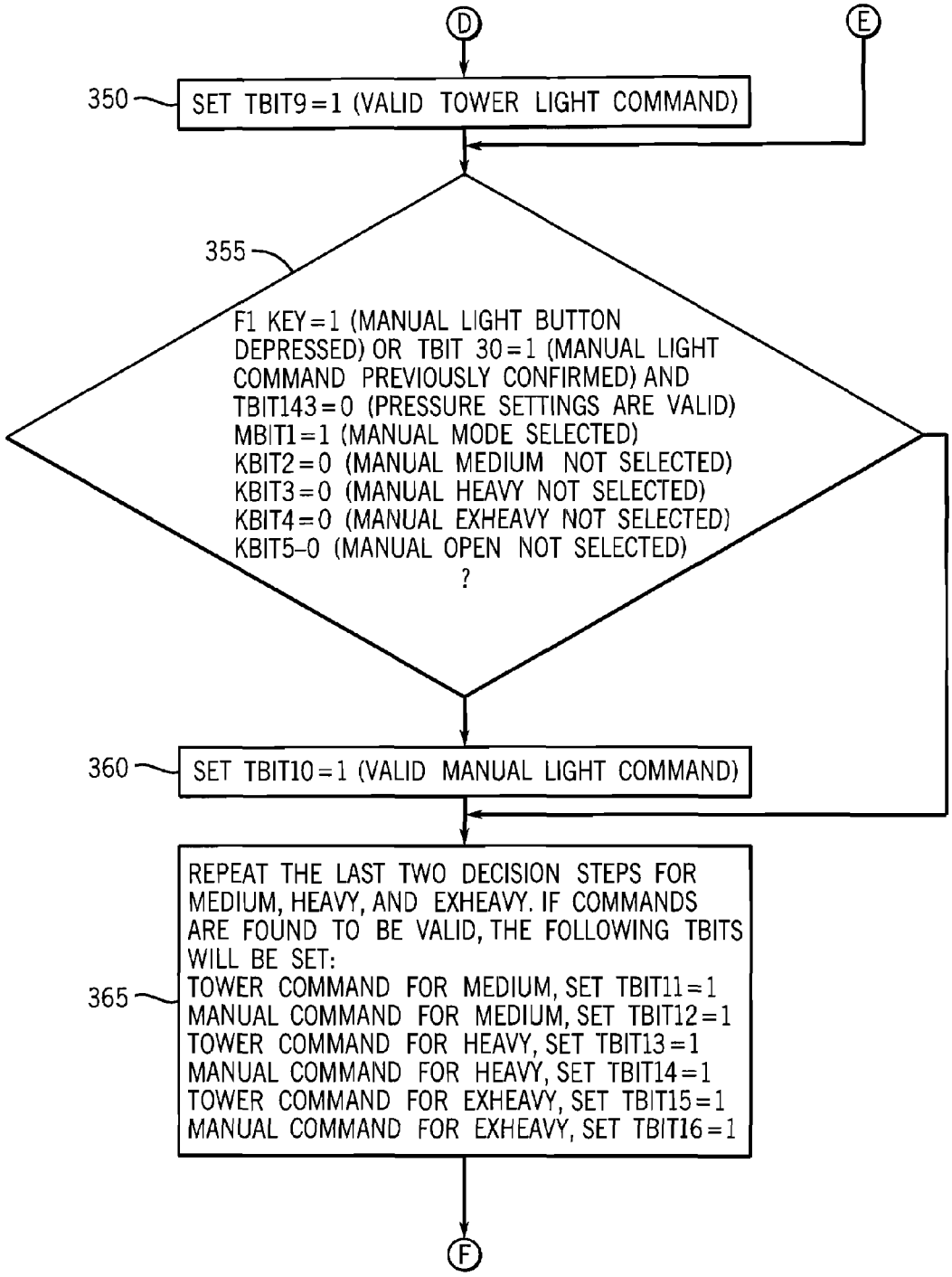
Figure 17E:
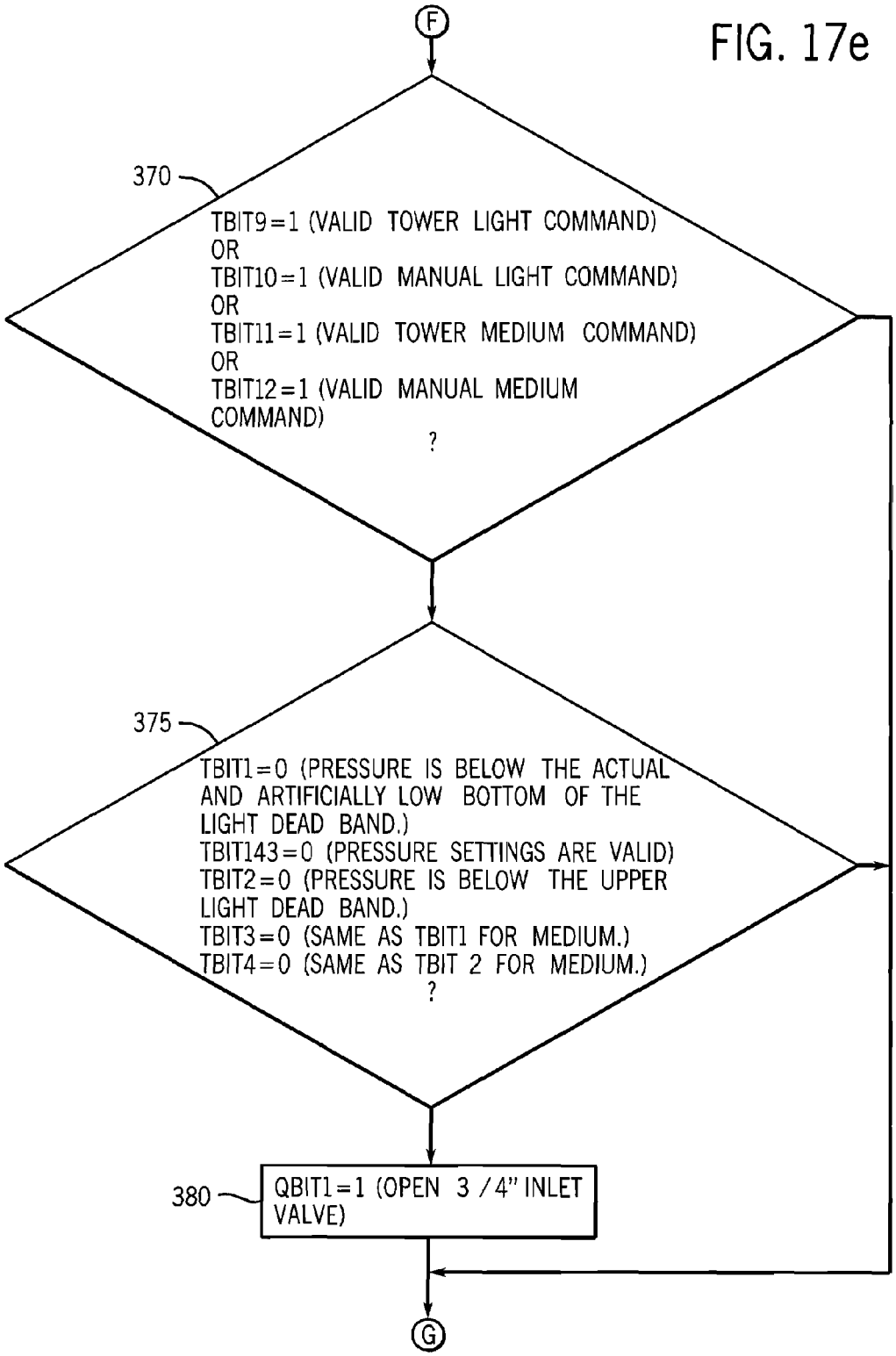
Figure 17F:
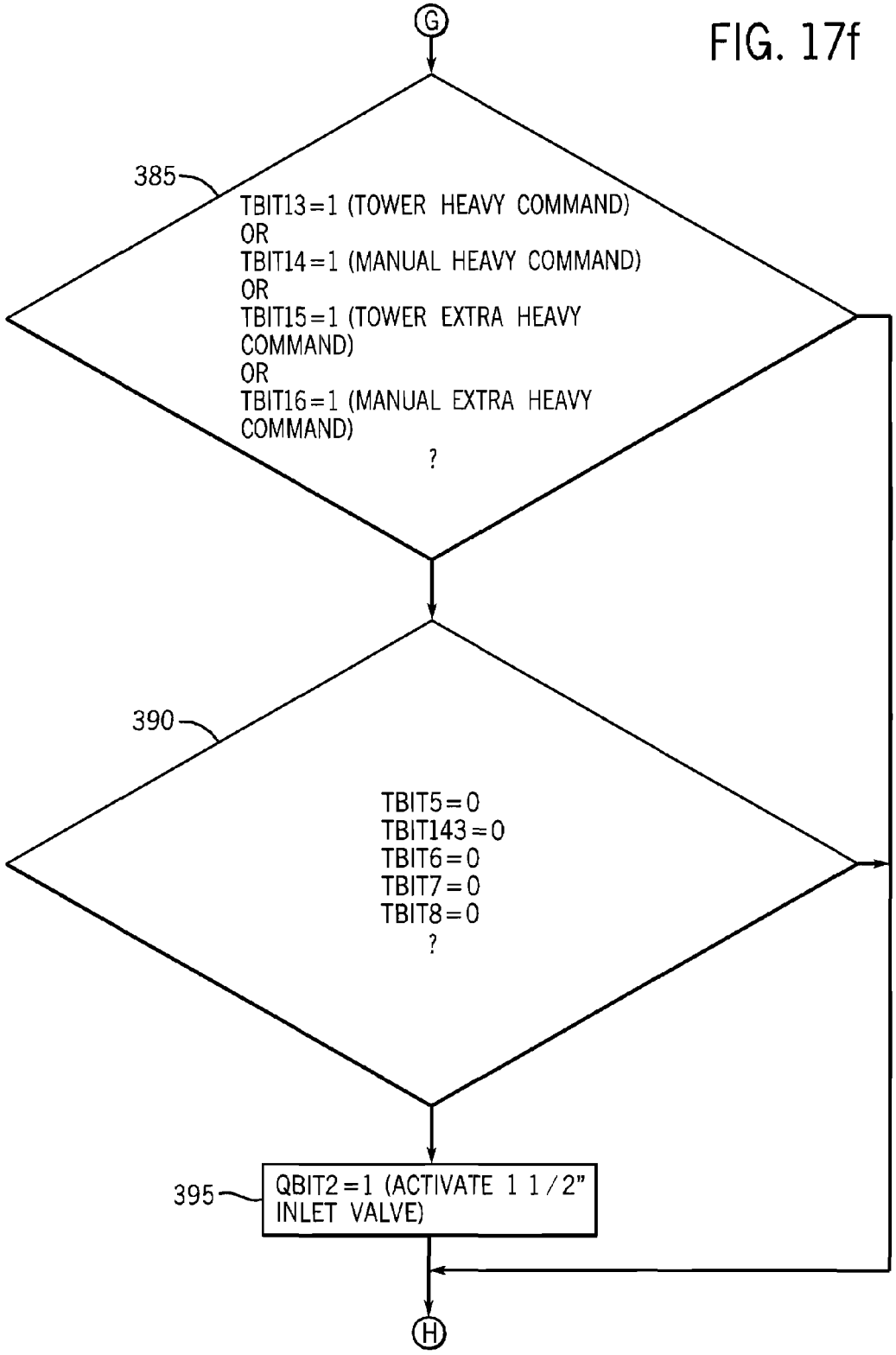
Figure 17G:
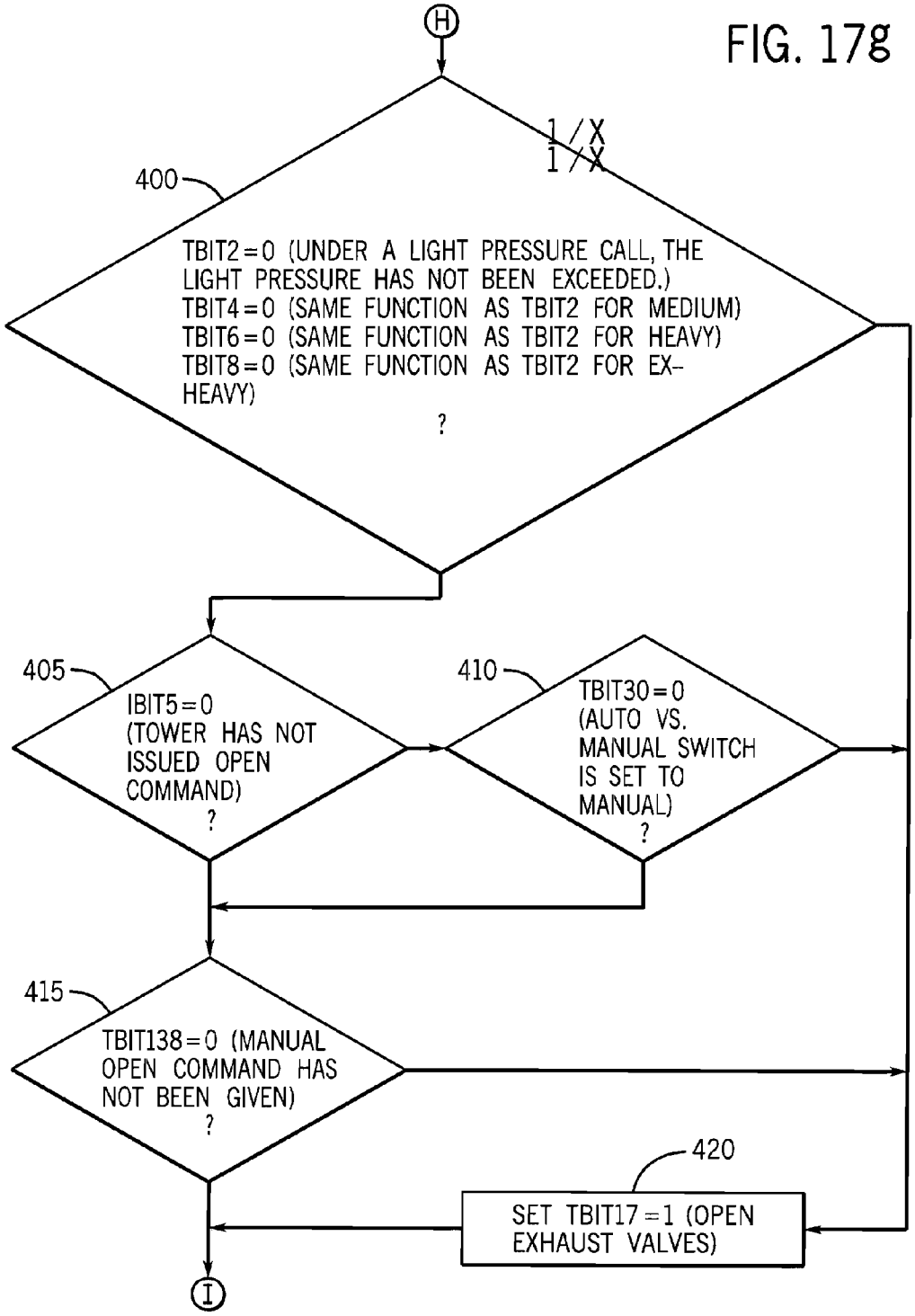
Figure 17H:
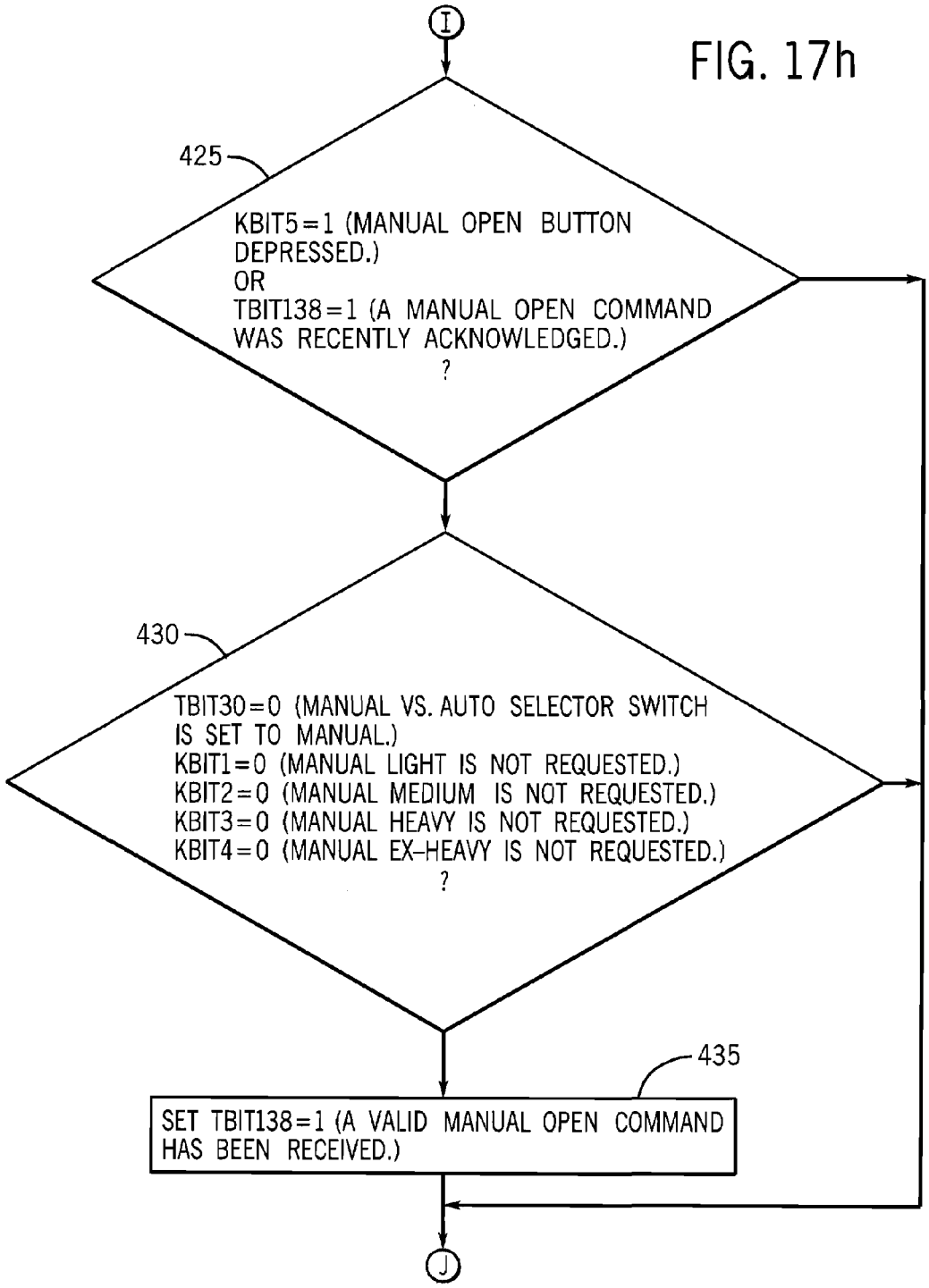
Figure 17I:
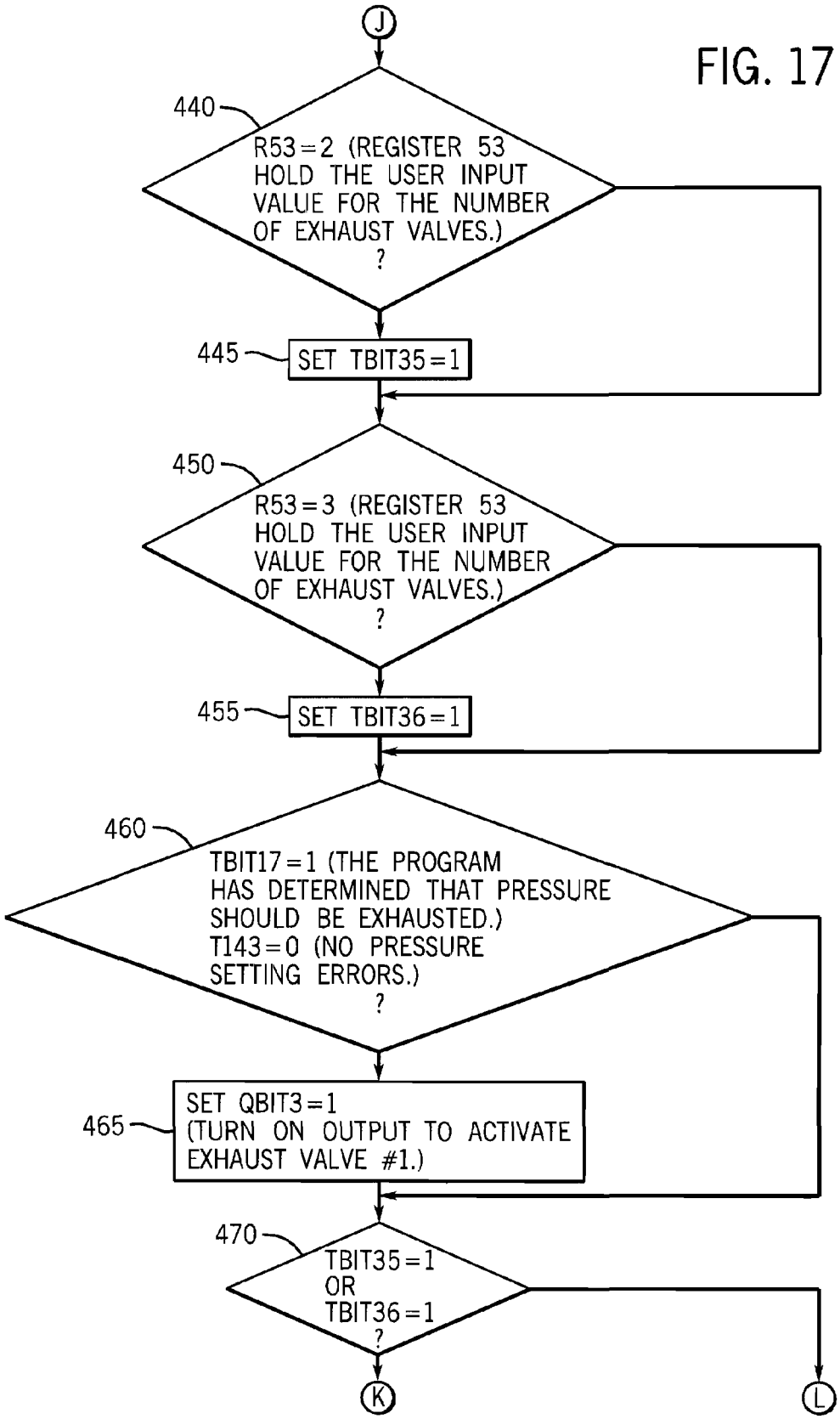
Figure 17J:
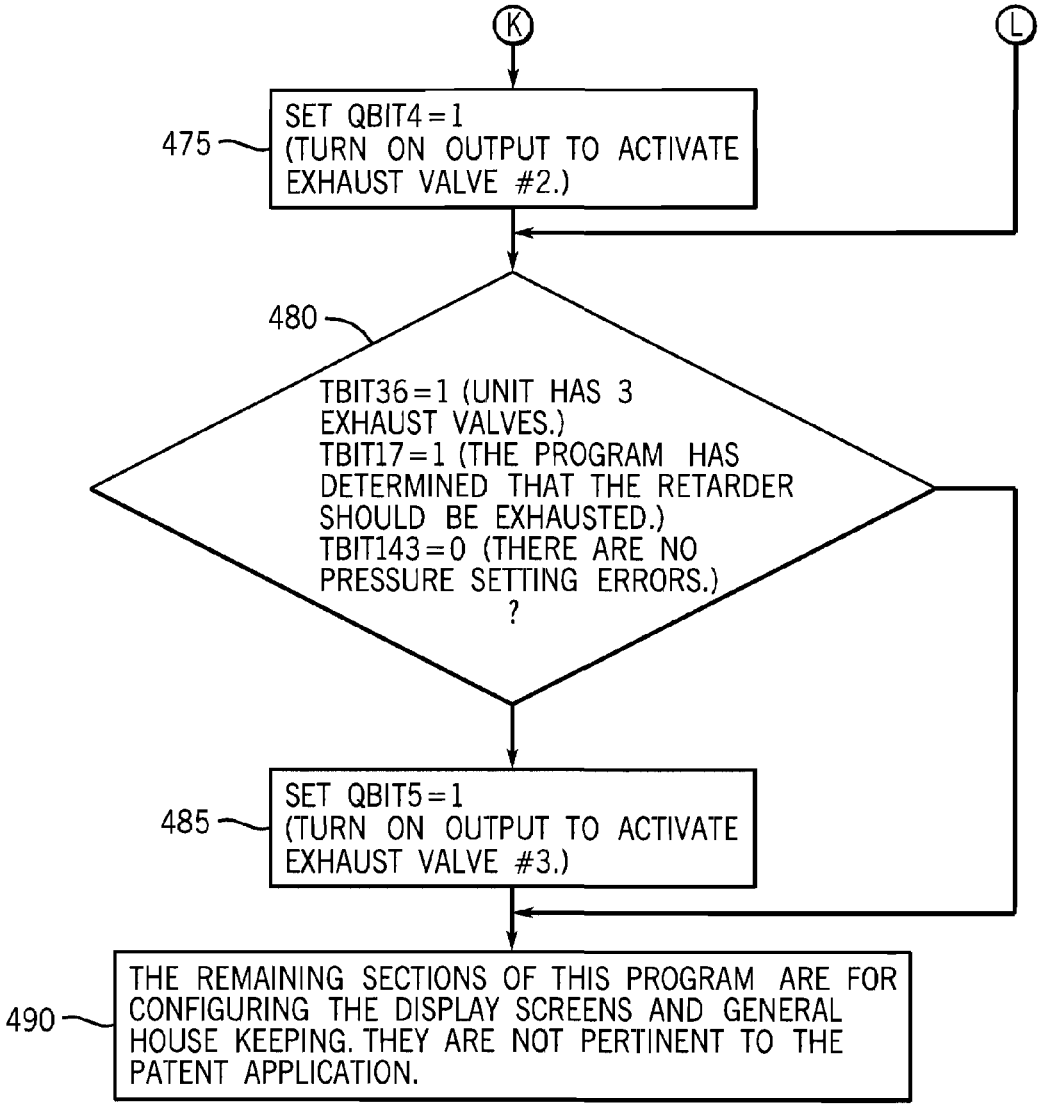

A schematic diagram of the operating program is shown in FIGS. 17*a-j*, which includes a legend in FIG. 17*k*. The program begins (200, 205) by scaling the signals from the pressure transducer 145 and temperature transducer (not shown) so that this actual pressure and temperature information can be displayed in recognizable units, such as psi and ° F. These values are displayed on the LCD display 61 so that field personnel can verify proper operation. The program then determines if a LIGHT weight class command or power setting was given (210, 215). If a LIGHT command was given, the program then determines if any of the valves 121-125 need to be actuated to adjust the pressure in the retarder to a LIGHT setting. The upper and lower pressure limit of each power setting has a dead band of about 2 psi to prevent sporadic operation of the pilot valves 141 at these pressure limits caused by fluctuations in the actual pressure in the retarder or the signal sent from the pressure transducer 145. The PLC module and program do not send a signal to the pilot valve or alter the open or closed state of the control valve when the actual pressure data from the transducer is within the dead band. When the actual pressure in the retarder is at or approaches one of the pressure limits of the user specified range, the dead band prevents these fluctuations in the signal or air pressure from causing the PLC module 69 to send signals to the pilot valves 141 to open and close so quickly that the main valves do not cycle but pilot valve actuation occurs. The dead band at the upper and lower pressure limits prevents this unwanted cycling and wear of the pilot valves 141. A portion of the program logic (210 to 315) includes the commands for setting these limits. If the actuation of valve 121-125 is deemed necessary by the PLC module 69 when it compares the actual retarder pressure data received from the pressure transducer 145 to the desired upper of lower limits for the presently selected weight class or power setting, the value of TBIT1 (290) or TBIT2 (315) will be changed to indicate if pressurized air form the yard compressed air system needs to be added to the retarder or exhausted from the retarder. The program logic (210 to 315) for determining if the LIGHT power setting command requires valve 121-125 actuation is then repeated for each of the other weight classes (MEDIUM—TBIT3 or TBIT4, HEAVY—TBIT5 or TBIT6 or EXTRA HEAVY—TBIT7 or TBIT8).

Program logic (325 to 340) determines if the PLC module 69 is instructed to be in TOWER or MANUAL mode. When in TOWER mode, the EPRC valve 10 does not respond to any MANUAL commands. This is important because the valve 10 is being used to control the speed of railcars being assembled into trains when in the TOWER mode. An accident or derailment could occur if the valve 10 responded to an accidental MANUAL command. When in MANUAL mode, the valve 10 does not respond to TOWER commands. This is important because the MANUAL mode is implemented by retarder servicemen maintaining or repairing the EPRC valve 10 or its associated retarder. If the valve 10 were to respond to an accidental TOWER command while in MANUAL mode, servicemen could be injured.

The next step in the program is to determine if a valid LIGHT command has been given. For there to be a valid TOWER LIGHT command (345), the PLC module 69 must be in TOWER (AUTO) mode, the control tower must be requesting a LIGHT power or weight class setting, the upper and lower pressure limits for the weight classes must be reasonable (upper limit of pressure range must be above lower limit of pressure range), and the tower must not be requesting any other weight classes. Experience with this equipment has revealed that, as a result of either poor control system programming, damaged wiring or lightening protection systems, it is possible for the unit to receive signals to go to multiple weight classes at the same time. If this occurs, the operating program will not acknowledge the signals until a single signal is received. Similar program logic (355) is used to determine if a valid MANUAL LIGHT signal has been received. The program logic (345 to 360) is then repeated for each of the other weight classes to verify if a valid TOWER or MANUAL signal has been received.

The program (370, 375) determine if the ¾ inch inlet valve 121 should be opened, and then (380) sends a signal to actuate the pilot valve 141 and open the valve 121. The program will not send a signal to the corresponding pilot valve 141 to open valve 121 unless the actual pressure in the retarder is below both the user specified lower limit of the selected weight class and the dead band established for that lower limit. The ¾ inch valve 121 is only used to allow air into the retarder during a LIGHT or MEDIUM command. A smaller flow rate and amount of pressurized air from the yard system is required to achieve these two weight classes in an adequate response time. Use of the larger inlet valve 122 may result in the pressure in the retarder rising too quickly, which could cause retarder pressure to exceed the maximum pressure for the weight class before the inlet valve 122 has a chance to close. The program (385 to 395) determines if the 1½ inch inlet valve 122 should be opened. This portion of the program is similar to portion (370 to 380) except for the HEAVY and EXTRA HEAVY weight classes. The 1½ inch valve 122 is used when a rapid inrush of pressurized air is needed to bring the retarder up to the desired pressure.

The program (400 to 420) determines if the exhaust valves 123-125 need to be opened because either the upper limit and dead band pressure for a weight class is exceeded or a valid TOWER OPEN command is received. The program (425 to 435) determines if a valid MANUAL OPEN command is received. The program is configured so that the unit 10 will respond to either a continuous or momentary depression of the OPEN button. However, the PLC must be in MANUAL mode and no other MANUAL commands may be active. The program (440 to 485) determines how many exhaust valves 123-125 the user has told the PLC are in the unit 10 and activates those valves if a valid OPEN signal is received.

While the invention has been described with reference to a preferred embodiment, it will be understood by those skilled in the art that various changes may be made and equivalents may be substituted without departing from the broad aspects of the invention.

What is claimed is:

1. A modular retarder control valve for selectively controlling a flow of pressurized air supplied to and discharged from a pneumatic retarder in a railroad marshalling yard, said marshalling yard having a compressor producing a pressurized air supply, said modular retarder control valve comprising:

a housing having an interior compartment containing an intake/exhaust manifold, a supply/return manifold and first, second and third control lines positioned between said manifolds;

said intake/exhaust manifold having an intake pathway for receiving pressurized air from the pressurized air supply of the yard and an exhaust pathway for exhausting the air from said retarder, said intake/exhaust manifold having a first set of ports including first, second and third matable ports, said intake pathway being in pneumatic communication with at least one of said matable ports, and said exhaust pathway being in pneumatic communication with at least one other of said matable ports;

said supply/return manifold having a supply pathway for supplying the pressurized air to said retarder and a return pathway for returning air from said retarder, said supply/return manifold having a second set of ports including first, second and third matable ports, said supply pathway being in pneumatic communication with at least one of said matable ports, and said return pathway being in pneumatic communication with at least one other of said matable ports; and, said first, second and third control lines, each of said control lines forming a separate flow path and having a control valve selectively movable between open and closed positions to control the flow of the pressurized air along its said flow path, said control lines using interchangeable fastening mechanisms to releasably secure said opposed ends of each said control line to said intake/exhaust and supply/return manifolds, said first control line pneumatically connecting said first matable port of said intake/exhaust manifold to said first matable port of said supply/return manifold, said second control line pneumatically connecting said second matable port of said intake/exhaust manifold to said second matable port of said supply/return manifold, and said third control line pneumatically connecting said third matable port of said intake/exhaust manifold to said third matable port of said supply/return manifold; and wherein said manifolds are fixed a predetermined distance apart with said first set of ports being diametrically opposed to said second set of ports, and each of said control lines extends between said manifolds, said control line having an expansion joint between its opposed ends to facilitate the release and securement of said control line to said manifolds.

2. The modular retarder control valve of claim 1, and wherein said manifolds form facing parallel surfaces, and said matable ports are located at evenly spaced distances along said parallel surfaces, each mating port in said intake/exhaust manifold has a corresponding mating port in said supply/return manifold that is located directly opposite, and each of said control lines being perpendicular to said parallel surfaces of said manifold blocks.

3. The modular retarder control valve of claim 2, and wherein at least two of said control lines have a substantially equal length and are interchangeable.

4. The modular retarder control valve of claim 3, and wherein each of said interchangeable fastening mechanisms is a like-shaped flange and bolt assembly that is matingly received around one of said matable ports.

5. The modular retarder control valve of claim 4, and wherein each of said manifolds is an integral block.

6. A modular retarder control valve for selectively controlling a flow of pressurized air supplied to and discharged from a pneumatic retarder in a railroad marshalling yard, said marshalling yard having a compressor producing a pressurized air supply, said modular retarder control valve comprising:

a housing having an interior compartment with intake, exhaust, supply and return quadrants, said intake and exhaust quadrants forming an intake/exhaust section and said supply and return quadrants forming a supply/return section;

said intake quadrant having an intake pathway for receiving pressurized air from the pressurized air supply of the yard, said exhaust quadrant having an exhaust pathway for exhausting the air from said retarder, said intake/exhaust section having a first set of ports including first, second and third matable ports, said intake pathway being in pneumatic communication with at least one of said matable ports, and said exhaust pathway being in pneumatic communication with at least one other of said matable ports;

said supply quadrant having a supply pathway for supplying the pressurized air to said retarder, said return quadrant having a return pathway for returning air from said retarder, said supply/return section having a second set of ports including first, second and third matable ports, said supply pathway being in pneumatic communication with at least one of said matable ports, and said return pathway being in pneumatic communication with at least one other of said matable ports; and, first, second and third control lines, each of said control lines forming a separate flow path and having a control valve selectively movable between open and closed positions to control the flow of the pressurized air along its said flow path, said control lines using interchangeable fastening mechanisms to releasably secure said control lines to said modular retarder control valve, said first control line pneumatically connecting said first matable port of said intake/exhaust section to said first matable port of said supply/return section, said second control line pneumatically connecting said second matable port of said intake/exhaust section to said second matable port of said supply/return section, and said third control line pneumatically connecting said third matable port of said intake/exhaust section to said third matable port of said supply/return wherein said intake/exhaust section has a intake/exhaust manifold and said supply/return section has a supply/return manifold, said intake and exhaust pathways and first set of ports are formed by said intake/exhaust manifold, said supply and return pathways and second set of ports are formed by said supply/return manifold; section; and wherein said manifolds are fixed a predetermined distance apart with said first set of ports being diametrically opposed to said second set of ports, and each of said control lines extends between said manifolds, said control line having an expansion joint between its opposed ends to facilitate the release and securement of said control line to said manifolds.

7. The modular retarder control valve of claim 6, and wherein each of said manifolds is an integral block.

8. The modular retarder control valve of claim 6, and wherein each of said manifolds is formed by two separate blocks, each separate block being fixed to said housing in an aligned manner.

9. The modular retarder control valve of claim 6, and wherein each control valve is actuated by a separate pilot air valve.

10. The modular retarder control valve of claim 9, and wherein each pilot air valve is actuated by an electric solenoid.

11. The modular retarder control valve of claim 10, and wherein said pilot air valve and electric solenoid work in combination to direct pressurized pilot air to one of two sides of a piston in each corresponding control valve to move that valve into either said open or said closed position.

12. The modular retarder control valve of claim 6, and wherein said manifolds form facing parallel surfaces, and said matable ports are located at evenly spaced distances along said parallel surfaces, each mating port in said intake/exhaust manifold has a corresponding mating port in said supply/return manifold that is located directly opposite, and each of said control lines being perpendicular to said parallel surfaces of said manifold blocks.

13. The modular retarder control valve of claim 12, and wherein at least two of said control lines have a substantially equal length and are interchangeable.

14. The modular retarder control valve of claim 13, and wherein each of said control valves is a pneumatically operated valve that allows pressurized air to flow in one direction along its said flow path.

15. The modular retarder control valve of claim 13, and wherein each of said interchangeable fastening mechanisms is a like-shaped flange and bolt assembly that is matingly received around one of said matable ports.

16. The modular retarder control valve of claim 12, and wherein said intake/exhaust manifold has a fourth matable port, said supply/return manifold has a fourth matable port, and further including a fourth control line that pneumatically connects said fourth matable port of said intake/exhaust manifold to said fourth matable port of said supply/return manifold.

17. The modular retarder control valve of claim 16, and wherein said intake/exhaust manifold has a fifth matable port, said supply/return manifold has a fifth matable port, and further including a fifth control line that pneumatically connects said fifth matable port of said intake/exhaust manifold to said fifth matable port of said supply/return manifold.

* * * * *

UNITED STATES PATENT AND TRADEMARK OFFICE

CERTIFICATE OF CORRECTION

PATENT NO. : 7,325,567 B2
APPLICATION NO. : 10/887951
DATED : February 5, 2008
INVENTOR(S) : Thomas J. Heyden, Lowell B. Ziese and James D. Braatz It is certified that error appears in the above-identified patent and that said Letters Patent is hereby corrected as shown below:

Title Page, Item [54] Title & Col. 1, Line 1:

Delete "Pneumatic Retarder Acutator Valve" and substitute therefor --Pneumatic Retarder Actuator Valve.--

Signed and Sealed this

Twentieth Day of May, 2008

JON W. DUDAS
*Director of the United States Patent and Trademark Office*